US009048601B2

(12) United States Patent
Kimura

(10) Patent No.: US 9,048,601 B2
(45) Date of Patent: Jun. 2, 2015

(54) CONNECTOR

(71) Applicant: Japan Aviation Electronics Industry, Limited, Tokyo (JP)

(72) Inventor: Kousuke Kimura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 26 days.

(21) Appl. No.: 14/154,365

(22) Filed: Jan. 14, 2014

(65) Prior Publication Data

US 2014/0213115 A1 Jul. 31, 2014

(30) Foreign Application Priority Data

Jan. 28, 2013 (JP) ..... 2013-013578

(51) Int. Cl.

| | |
|---|---|
| ***H01R 24/00*** | (2011.01) |
| ***H01R 24/60*** | (2011.01) |
| *H01R 12/73* | (2011.01) |
| *H01R 107/00* | (2006.01) |

(52) U.S. Cl.

CPC ..... *H01R 24/60* (2013.01); *H01R 12/73* (2013.01); *H01R 2107/00* (2013.01)

(58) Field of Classification Search

CPC ..... H01R 13/64; H01R 13/66; H01R 24/00; H01R 33/00; H01R 9/26

USPC ..... 439/374, 347, 55, 660, 248, 620, 733.1, 439/629, 716, 676, 736

See application file for complete search history.

(56) References Cited

U.S. PATENT DOCUMENTS

| | | | | |
|---|---|---|---|---|
| 5,259,779 | A | 11/1993 | Ooya et al. | |
| 7,510,445 | B2 | 3/2009 | Tokunaga | |
| 7,635,274 | B2 | 12/2009 | Fukazawa et al. | |
| 8,257,095 | B2 * | 9/2012 | Akai et al. | 439/74 |
| 2007/0202729 | A1 * | 8/2007 | Uesaka | 439/248 |

FOREIGN PATENT DOCUMENTS

| | | | |
|---|---|---|---|
| JP | 2568142 | B2 | 12/1996 |
| JP | H10-312868 | A | 11/1998 |
| JP | 2004-063358 | A | 2/2004 |
| JP | 4190019 | B2 | 12/2008 |
| JP | 2009-230943 | A | 10/2009 |
| JP | 4411843 | B2 | 2/2010 |

* cited by examiner

*Primary Examiner* — Abdullah Riyami
*Assistant Examiner* — Nader J Alhawamdeh
(74) *Attorney, Agent, or Firm* — Collard & Roe, P.C.

(57) ABSTRACT

A connector is mateable with a mating connector along a first direction. The mating connector has a mating contact portion. The connector comprises a housing and a contact. The housing has a holding portion and a stop portion. The contact has a held portion, a pressed portion and a contact point. The held portion is held by the holding portion. The pressed portion is provided between the held portion and the contact point. The contact point is located between the held portion and the pressed portion in a second direction perpendicular to the first direction. The contact point is brought into contact with the mating contact portion and moved in the second direction under a mated state of the connector with the mating connector. The pressed portion is pressed against the stop portion when the contact point is brought into contact with the mating contact portion.

10 Claims, 16 Drawing Sheets

CONNECTOR

CROSS REFERENCE TO RELATED APPLICATIONS

An applicant claims priority under 35 U.S.C. §119 of Japanese Patent Application No. JP2013-013578 filed Jan. 28, 2013.

BACKGROUND OF THE INVENTION

This invention relates to a connector having a contact point which is brought into contact with a mating contact portion of a mating connector when the connector is mated with the mating connector.

For example, this type of connector is disclosed in JP-B 4190019 (Patent Document 1), content of which is incorporated herein by reference.

As shown in FIG. 31, the connector of Patent Document 1 comprises a contact and a housing holding the contact. The mating connector of Patent Document 1 comprises a mating contact and a mating housing holding the mating contact. The connector and the mating connector are mateable with each other along a first direction. The contact has a contact point and a contact portion. The contact point is movable in a second direction perpendicular to the first direction. Since the contact portion is in contact with the housing, the contact portion is hardly moved when the contact point is moved in the second direction. The mating contact has a mating contact point and a mating contact portion. The mating contact point is movable in the second direction. Since the mating contact portion is in contact with the mating housing, the mating contact portion is hardly moved when the mating contact point is moved in the second direction. When the connector and the mating connector are mated with each other, the contact point is brought into contact with the mating contact portion, while the mating contact point is brought into contact with the contact portion. Thus, the contact and the mating contact are brought into contact with each other at two points.

There is a request for the aforementioned connector and the mating connector of Patent Document 1 to increase the moving distances of the contact point and the mating contact point while preventing the contact point and the mating contact point from being brought into contact unnecessarily with some portions upon the mating of the connector with the mating connector.

SUMMARY OF THE INVENTION

It is therefore an object of the present invention to provide a connector which can satisfy this request.

One aspect of the present invention provides a connector mateable with a mating connector along a first direction. The mating connector comprises a mating contact having a mating contact portion. The connector comprises a housing and a contact. The housing has a holding portion and a stop portion. The contact has a held portion, a pressed portion and a contact point. The held portion is held by the holding portion. The pressed portion is provided between the held portion and the contact point. The contact point is located between the held portion and the pressed portion in a second direction perpendicular to the first direction. The contact point is brought into contact with the mating contact portion and moved in the second direction under a mated state where the connector and the mating connector are mated with each other. The pressed portion is pressed against the stop portion when the contact point is brought into contact with the mating contact portion.

An appreciation of the objectives of the present invention and a more complete understanding of its structure may be had by studying the following description of the preferred embodiment and by referring to the accompanying drawings.

Figure 1:
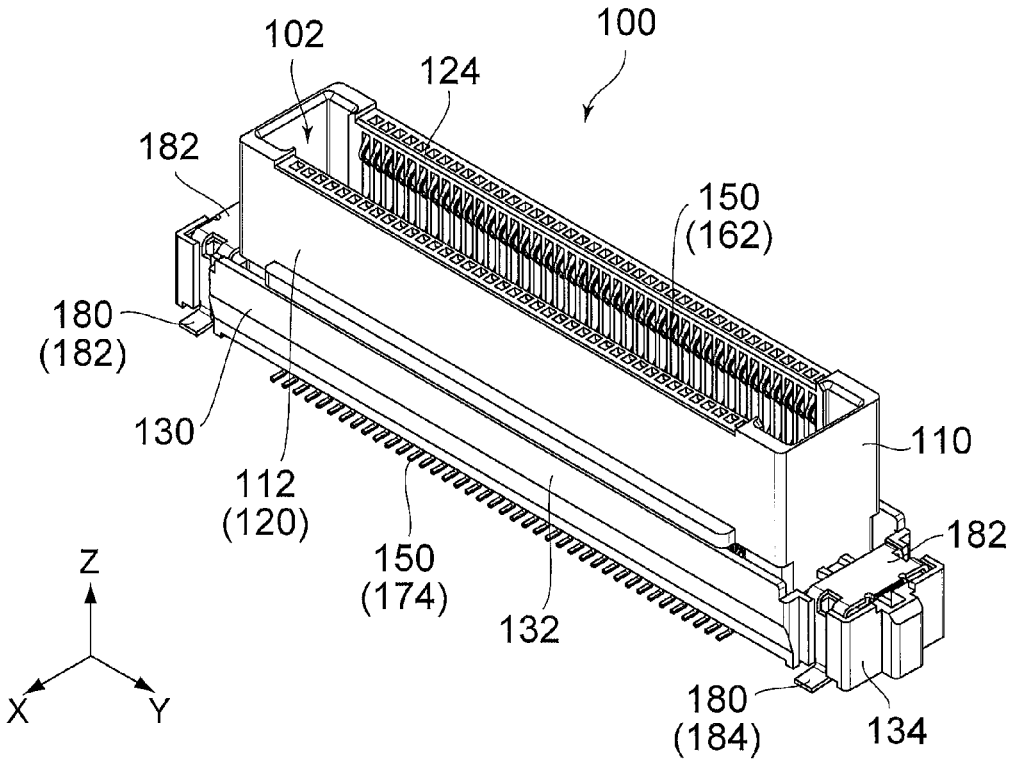
FIG. 1 is a top, perspective view showing a receptacle according to a first embodiment of the present invention.
Figure 2:
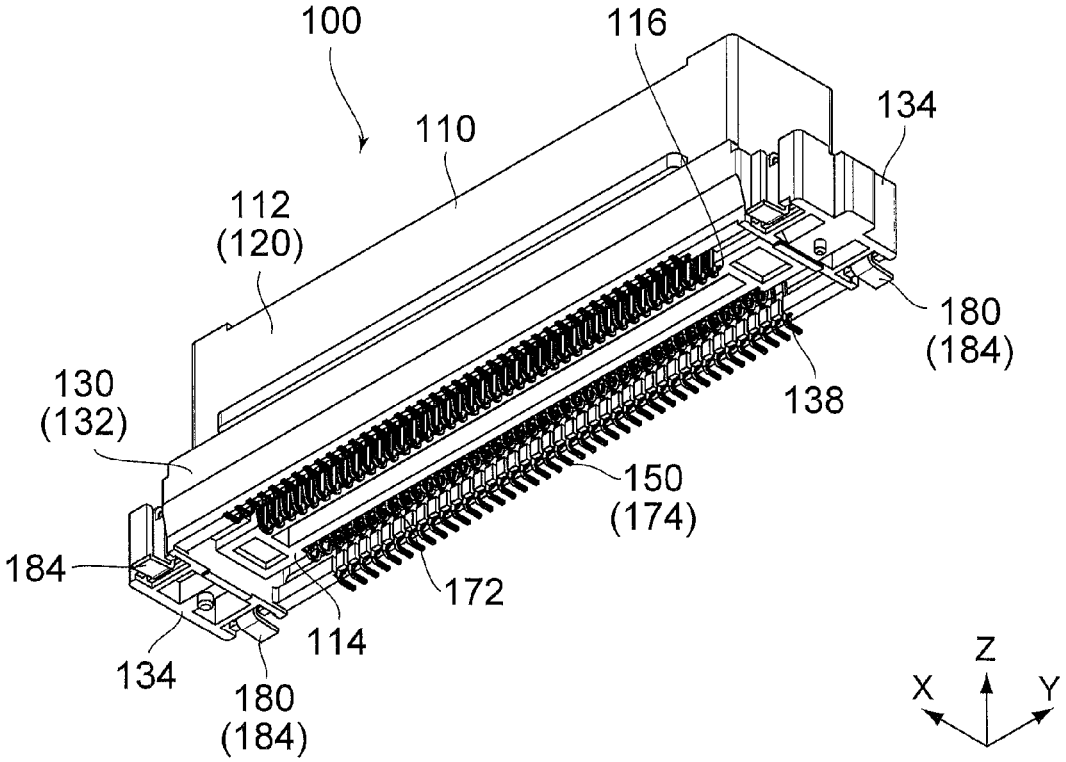
FIG. 2 is a bottom, perspective view showing the receptacle of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 9:
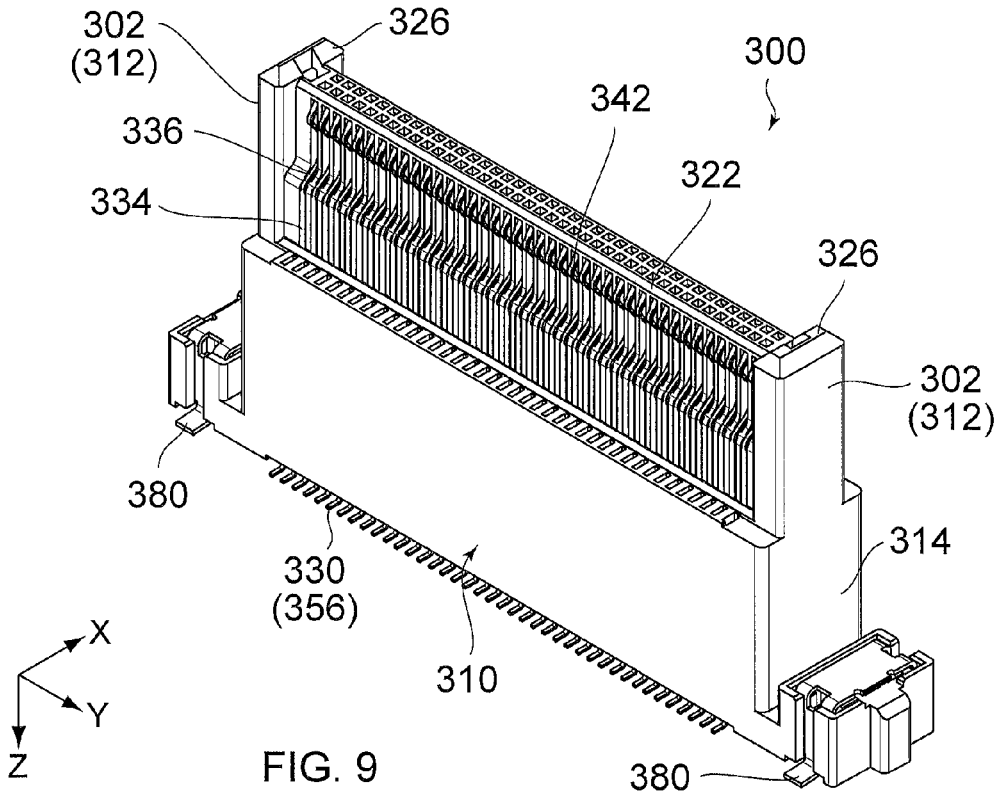
FIG. 9 is a top, perspective view showing a plug according to the first embodiment.

Referring to FIGS. 1 to 5, a connector according to a first embodiment of the present invention is a receptacle 100 having a floating structure. The receptacle 100 according to the present embodiment is to be mounted on and fixed to an object such as a circuit board (not shown). Referring to FIGS. 9 to 13, a mating connector according to the present embodiment is a plug 300. As shown in FIG. 1, the receptacle 100 has a receive portion 102 which opens in the Z-direction (first direction). As shown in FIG. 9, the plug 300 has a mating portion 302. As shown in FIGS. 15 to 18, the plug 300 and the receptacle 100 are mateable along the Z-direction (first direction) with each other by an insertion of the mating portion 302 into the receive portion 102. The receptacle 100 has a mating end at the positive Z-side thereof, while the plug 300 has another mating end at the negative Z-side thereof. Hereafter, the positive Z-side is referred to as an upper side in explanation about the receptacle 100, while the negative Z-side is referred to as another upper side in explanation about the plug 300. Thus, the mating end of the receptacle 100 is located at the upper side of the receptacle 100, and the mating end of the plug 300 is located at the upper side of the plug 300.

As shown in FIGS. 1 to 6, the receptacle (connector) 100 comprises a floating housing (housing) 110 made of an insulator, a base housing 130 made of an insulator other than the floating housing 110, a plurality of contacts 150 each made of a metal and two hold downs 180 each made of a metal other than the base housing 130. The floating housing 110, the base housing 130 and the two hold downs 180 are formed separately and distinct from one another. In other words, the floating housing 110, the base housing 130 and the two hold downs 180 are separated members separable from one another.

Figure 4:
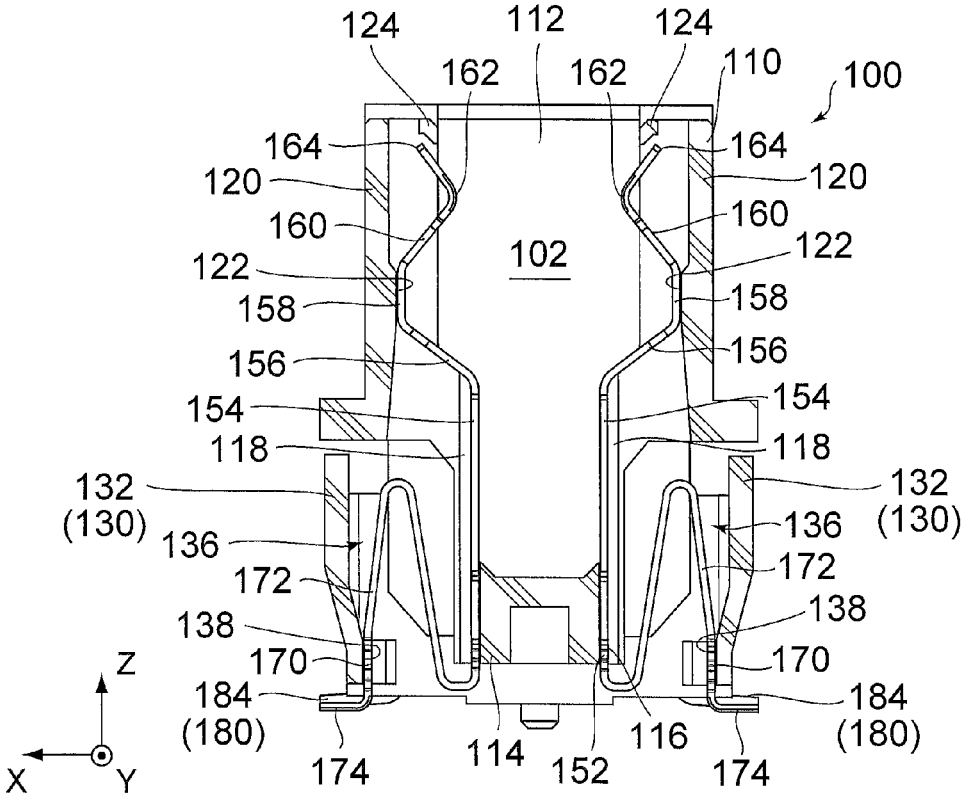
FIG. 4 is a cross-sectional view showing the receptacle of FIG. 3, taken along line IV-IV.
Figure 6:
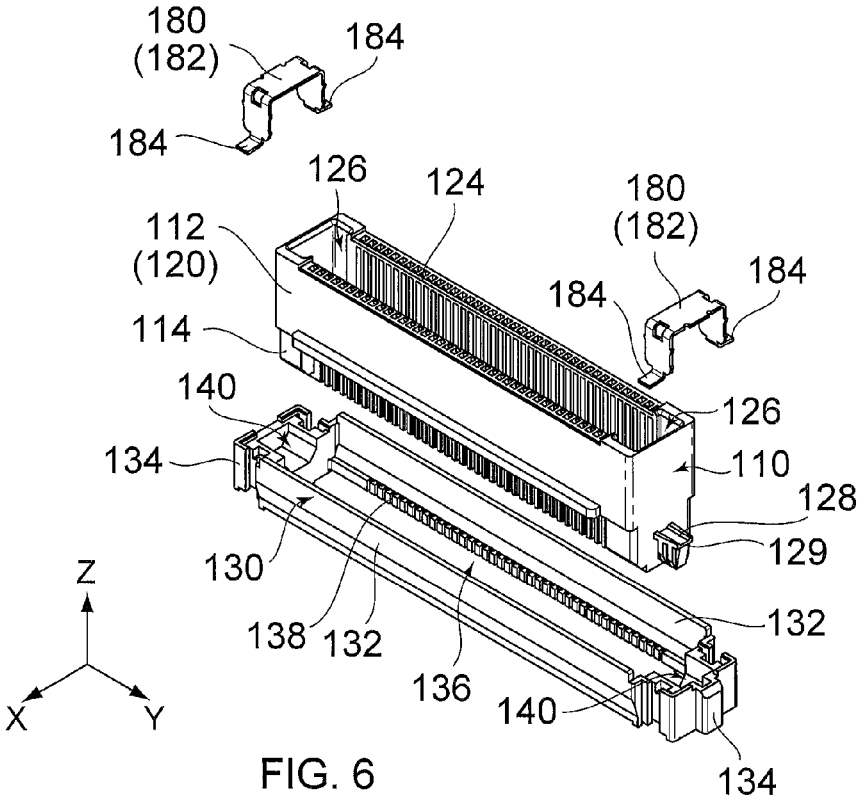
FIG. 6 is an exploded, perspective view showing the receptacle of FIG. 1, wherein contacts of the receptacle are not illustrated.

As shown in FIGS. 4 and 6, the floating housing 110 has an upper portion 112 and a lower portion 114. According to the present embodiment, the upper portion 112 is larger than the lower portion 114 in the XY-plane.

As shown in FIGS. 3, 4, 7 and 8, the lower portion 114 of the floating housing 110 is formed with a plurality of holding portions 116 which correspond to the contacts 150, respectively, and a plurality of second regulation portions 118 which correspond to the contacts 150, respectively. The holding portions 116 are grouped into two groups. The holding portions 116 of each group are arranged in the Y-direction (third direction, or pitch direction). Thus, the holding portions 116 are arranged in two rows. As described later, the holding portion 116 holds a part of the contact 150. The second regulation portion 118 is located outward of the holding portion 116 in the X-direction (second direction). As described later, the second regulation portion 118 regulates a movement outward in the X-direction of another part of the contact 150 that is held by the holding portion 116. In the present embodiment, a wall surface located outward of the holding portion 116 in the X-direction is connected to a surface, which faces inward in the X-direction, of the second regulation portion 118.

As shown in FIGS. 1, 4 and 6, the upper portion 112 of the floating housing 110 has a rectangular tube-like shape. The upper portion 112 includes two upper peripheral walls 120. These upper peripheral walls 120 are arranged to be apart from each other in the X-direction. Each of the upper peripheral walls 120 is formed with a plurality of stop portions 122 which correspond to the contacts 150, respectively. As described later, the stop portion 122 is to be pressed by a part of the contact 150. Moreover, the upper peripheral walls 120 are provided with guard portions 124, respectively. The guard portion 124 is located in the vicinity of an upper end (the positive Z-side end) of the upper peripheral wall 120. As described later, the guard portion 124 is to guard ends of the contacts 150.

Figure 3:
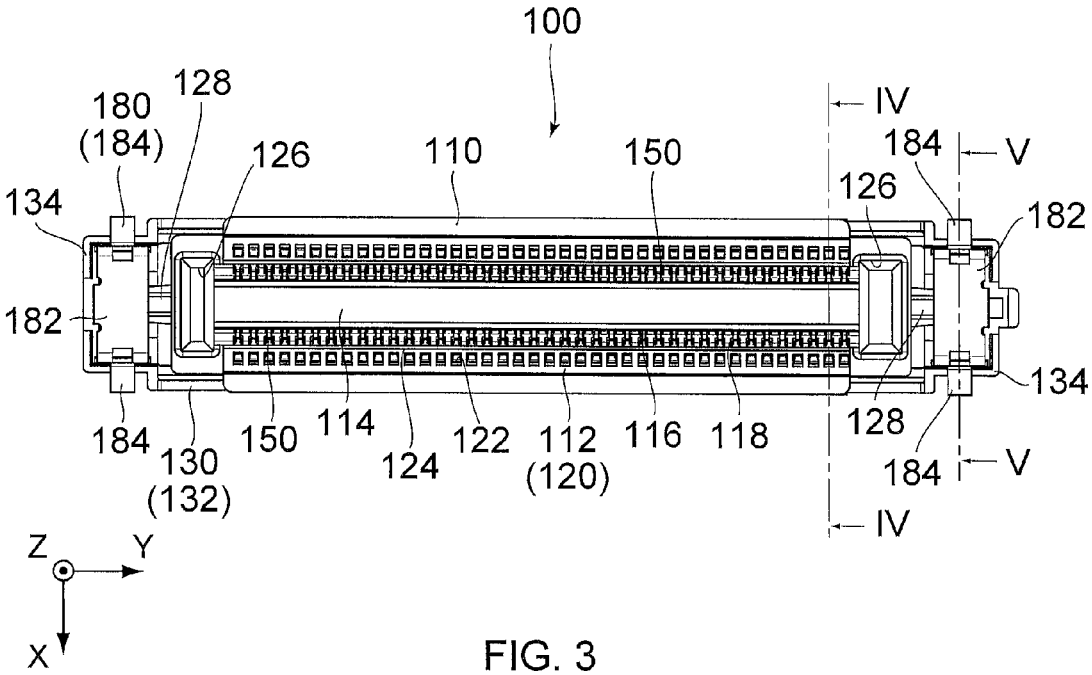
FIG. 3 is a top view showing the receptacle of FIG. 1.

Referring to FIGS. 3 and 6, the floating housing 110 is formed with two guide ditches 126 extending in the Z-direction. The guide ditches 126 are located in the vicinities of opposite ends of the upper peripheral wall 120 in the Y-direction, respectively.

Referring to FIG. 6, the lower portion 114 of the floating housing 110 is provided with two protrusions 128. Each of the protrusions 128 protrudes outward in the Y-direction to have an end 129 in the Y-direction. In the present embodiment, each of the protrusions 128 is formed as a part of the floating housing 110. More specifically, the protrusions 128 are formed integrally with the lower portion 114 of the floating housing 110. However, the present invention is not limited thereto. For example, the protrusion 128 may be formed of a component other than the floating housing 110 and fixed to the lower portion 114 to protrude outward in the Y-direction.

As best shown in FIG. 6, the base housing 130 has two side walls 132 and two end blocks 134. The side walls 132 are arranged to be apart from each other in the X-direction. The end blocks 134 are located at opposite ends of the side wall 132 in the Y-direction, respectively. The base housing 130 is formed with a space 136 which is surrounded by the side walls 132 and the end blocks 134 in the XY-plane. As can be seen from FIGS. 4 and 6, the space 136 receives the lower portion 114 of the floating housing 110.

As shown in FIGS. 4 and 6, each of the side walls 132 of the base housing 130 is formed with a plurality of additional holding portions 138 which correspond to the contacts 150, respectively. The additional holding portion 138 is located in the vicinity of a lower end (the negative Z-side end) of the side wall 132. As described later, the additional holding portion 138 holds a part of the contact 150. Similar to the holding portions 116, the additional holding portions 138 are grouped into two groups. The additional holding portions 138 of each group are formed to be arranged in the Y-direction.

Figure 5:
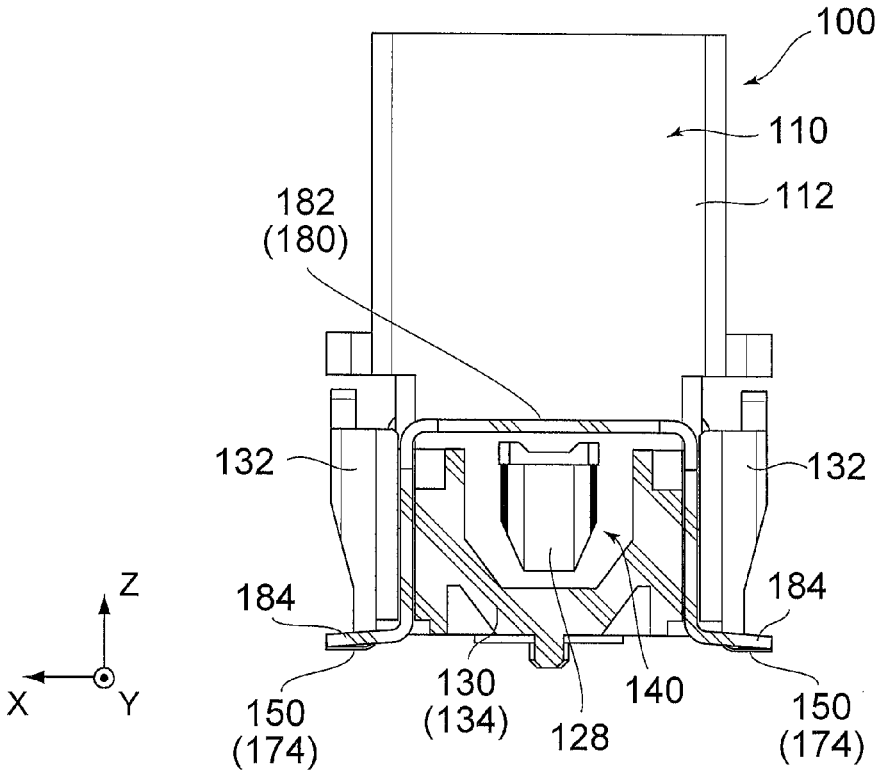
FIG. 5 is a cross-sectional view showing the receptacle of FIG. 3, taken along line VV.

As shown in FIGS. 5 and 6, the end blocks 134 of the base housing 130 are formed with indentions 140, respectively. The indentions 140 extend outward in the Y-direction while recessed in the negative Z-direction (downward). As can be seen from FIGS. 4 to 6, when the lower portion 114 of the floating housing 110 is received in the space 136 of the base housing 130, the protrusions 128 are received in the indentions 140, respectively. As can be seen from FIG. 5, a size of the protrusion 128 in the XZ-plane is rather smaller than another size of the indention 140 in the XZ-plane. Moreover, a size of the protrusion 128 in the Y-direction is smaller than another size of the indention 140 in the Y-direction. Accordingly, in the indention 140, the protrusion 128 is pivotable to some extent about an axis in parallel to the Y-direction and movable to some extent in the Y-direction.

As shown in FIGS. 1 to 5, the hold downs 180 are attached to the end blocks 134 of the base housing 130, respectively. Each of the hold downs 180 has two fixed portions 184. When the receptacle 100 is mounted on and fixed to the circuit board (not shown), the fixed portions 184 are fixed to the circuit board by soldering or the like. Thus, the base housing 130 is fixed to the circuit board by the four fixed portions 184. The fixed portions 184 are arranged to be located on four corners of a square, respectively. Accordingly, even if the base housing 130 receives such a force that urges the base housing 130 to rotate in the XY-plane, the base housing 130 can be prevented from being removed from the circuit board. According to the present embodiment, the two fixed portions 184 are formed to protrude outward in the X-direction. However, the present invention is not limited thereto. The fixed portions 184 may be formed variously, provide that each of the hold downs 180 has at least two fixed portions 184. For example, the hold down 180 may have three fixed portions 184 including the fixed portion 184 which is formed to protrude in the Y-direction.

As shown in FIGS. 1, 3, 5 and 6, each of the hold downs 180 is provided with a flat coupling portion (first regulation portion) 182. The flat coupling portion 182 is provided as a part of a coupling portion that couples the two fixed portions 184 with each other. In detail, the flat coupling portion 182 is a flat part having a surface in parallel to the XY-plane.

As shown in FIG. 5, the flat coupling portion 182 provided so as to be over the indention 140. Accordingly, a movement of the protrusion 128 along the Z-direction (first direction), especially, an upward movement along the positive Z-direction, is regulated by the flat coupling portion 182. The first regulation portion (flat coupling portion) 182 according to the present embodiment is a part of the hold down 180. However, the present invention is not limited thereto. For example, the first regulation portion may be formed integrally with the base housing 130. Moreover, the first regulation portion may be formed of a member other than any of the base housing 130 and the hold down 180. In this case, the first regulation portion may be fixed to the base housing 130 so as to regulate the movement of the protrusion 128 in the Z-direction.

As can be seen with comparison between FIGS. 3 and 6, the flat coupling portion 182 hides the end 129 of the protrusion 128 when seen from the positive Z-side (upper side) thereof along the Z-direction. Accordingly, when the protrusion 128 is moved in the positive Z-direction (upward), the flat coupling portion 182 can stop the protrusion 128. Thus, the flat coupling portion 182 can securely regulate the movement of the protrusion 128. For example, when the floating housing 110 is moved to be apart from the base housing 130 in the Z-direction, the flat coupling portions 182 stop the protrusions 128 and regulate a movement of the floating housing 110 in the Z-direction. The first regulation portion 182 according to the present embodiment has a planar shape in parallel to the XY-plane. However, the present invention is not limited thereto. For example, even if the first regulation portion has a curved planar shape, a similar effect can be obtained. Moreover, the first regulation portion can be formed of an edge portion of a metal plate. However, in this case, if the protrusion 128 is moved in the Y-direction, the protrusion 128 might come off the first regulation portion so that the desirable regulation of the movement might not be obtained. The first regulation portion 182 according to the present embodiment receives the protrusion 128 by its surface so that the first regulation portion 182 can securely regulate the movement of the protrusion 128 in the Z-direction even when the protrusion 128 is moved in the Y-direction.

As best shown in FIG. 4, each of the contacts 150 has a held portion 152, a contact portion 154, a support portion 156, a pressed portion 158, a resilient portion 160, an additional held portion 170, a flex portion 172 and a connected portion 174. The contact 150 also has a contact end 164. The contact 150 according to the present embodiment is formed by punching out and bending a single metal plate.

Figure 7:
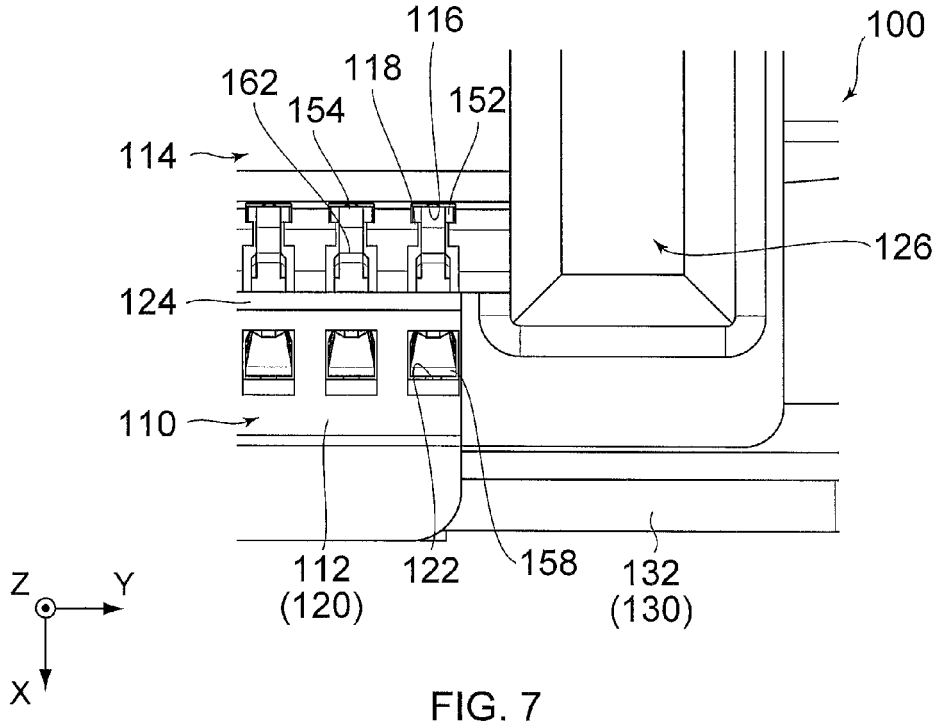
FIG. 7 is an enlarged, top view showing a part of the receptacle of FIG. 3.
Figure 8:
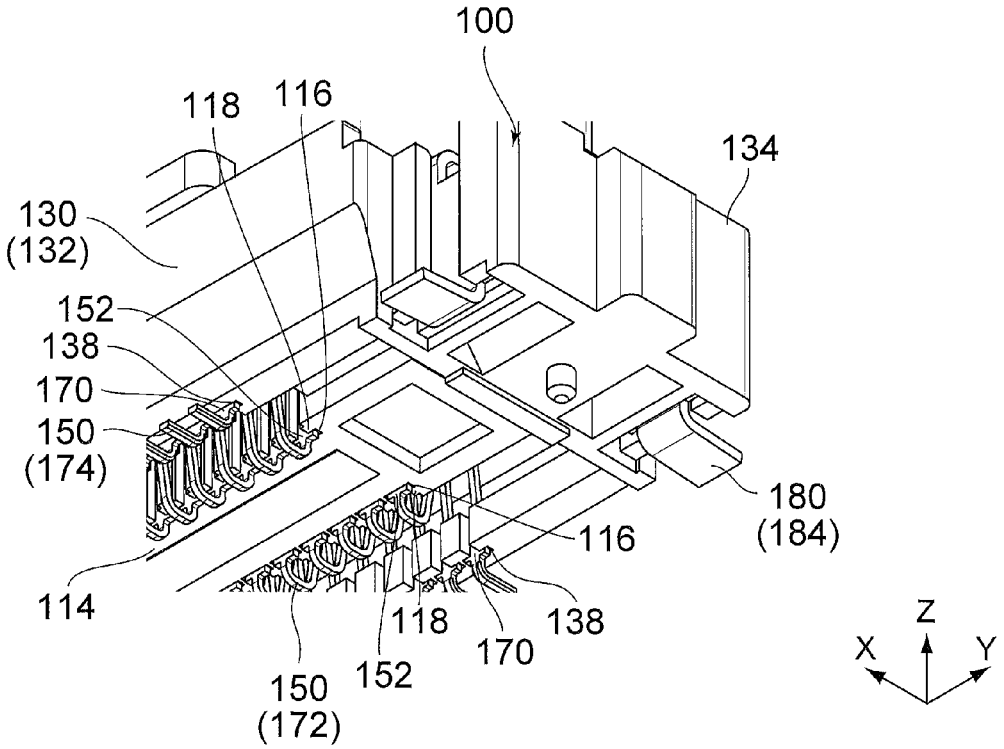
FIG. 8 is an enlarged, perspective view showing a part of the receptacle of FIG. 2.

As shown in FIGS. 4, 7 and 8, the held portions 152 are held by the holding portions 116 of the floating housing 110, respectively. Accordingly, the contacts 150 according to the present embodiment are arranged in two rows. The contact portion 154 extends upward along the positive Z-direction from the held portion 152. The second regulation portion 118 is located outward of the contact portion 154 in the X-direction. Accordingly, the contact portion 154 is not resiliently deformed outward in the X-direction beyond the second regulation portion 118. Thus, a movement of the contact portion 154 in the X-direction is regulated by the second regulation portion 118. The support portion 156 extends in a direction intersecting the Z-direction and the X-direction from an upper end of the contact portion 154. The support portion 156 supports the pressed portion 158.

As shown in FIGS. 4 and 7, the pressed portion 158 extends upward along the positive Z-direction from the support portion 156. Thus, the contact portion 154 is provided between the pressed portion 158 and the held portion 152. The pressed portion 158 is located inward of the stop portion 122 of the floating housing 110 in the X-direction. In the present embodiment, the pressed portion 158 is provided so as to be in contact with the stop portion 122 even under an unmated state where the receptacle 100 is not mated with the plug 300. However, the present invention is not limited thereto. For example, the pressed portion 158 may be configured to be brought into contact with and pressed against the stop portion 122 only under a mated state where the receptacle 100 and the plug 300 are mated with each other.

As shown in FIG. 4, the resilient portion 160 extends from the pressed portion 158. The resilient portion 160 has a contact point 162. The contact point 162 protrudes inward in the X-direction. The resilient portion 160 is resiliently deformable so that the contact point 162 is movable in the X-direction. The pressed portion 158 is provided between the resilient portion 160, which includes the contact point 162, and the held portion 152. The contact end 164 according to the present embodiment is an end of the resilient portion 160. The contact end 164 is located between the contact point 162 and the pressed portion 158 in the X-direction. The guard portion 124 is located over the contact end 164. Thus, in the present embodiment, the contact end 164 is guarded by the guard portion 124. Accordingly, the contact 150 can be prevented from being buckled by a direct abutment of some object with the contact end 164.

As shown in FIG. 4, when an outward force along the X-direction is applied to the contact point 162, the pressed portion 158 also receives an outward force along the X-direction. However, since the pressed portion 158 is pressed against the stop portion 122, a movement of the pressed portion 158 in the X-direction is limited. Accordingly, the outward force along the X-direction mainly deforms the resilient portion 160 resiliently. The thus-configured resilient portion 160 shows sufficient and stable resilient force. Thus, according to the present embodiment, contact reliability of the contact point 162 of the resilient portion 160 can be improved. Especially, in the present embodiment, the pressed portion 158 has a flat shape so that a flat surface of the pressed portion 158 is pressed against the stop portion 122. Accordingly, a starting point of the resilient deformation of the resilient portion 160 is steady.

As shown in FIGS. 4 and 7, the contact point 162 is located between the held portion 152 and the pressed portion 158 in the X-direction. Moreover, the contact point 162 is located between the contact portion 154 and the pressed portion 158 in the X-direction. In detail, the contact point 162 is located inward of the pressed portion 158 in the X-direction. Accordingly, a moving distance of the contact point 162 in the X-direction can be sufficiently enlarged. Moreover, the contact point 162 is located outward of the held portion 152 and the contact portion 154 in the X-direction. Accordingly, the contact point 162 can be prevented from being unnecessarily brought into contact with the plug 300 upon the mating of the receptacle 100 with the plug 300.

As shown in FIG. 4, the additional held portions 170 are held by the additional holding portions 138 of the base housing 130, respectively. The flex portion 172 is formed by bending to have an S-like or Z-like shape. The flex portion 172 couples the held portion 152 and the additional held portion 170 with each other. The coupling by the thus-configured flex portion 172 allows the held portion 152 to move relative to the additional held portion 170 in the XY-plane. Accordingly, the floating housing 110, which holds the held portions 152, is movable in the XY-plane relative to the base housing 130 which holds the additional held portions 170. In other words, the receptacle 100 has a floating structure. The flex portion 172 may have another shape such as a meander shape, provided that the floating structure can be configured. The held portion 152 according to the present embodiment is movable relative to the additional held portion 170 also in the Z-direction. Accordingly, the floating housing 110 is movable relative to the base housing 130 also in the Z-direction. However, the relative movement of the floating housing 110 in the Z-direction may be regulated or prevented.

The connected portion 174 extends opposite to the flex portion 172 from the additional held portion 170. When the receptacle 100 is mounted on and fixed to the circuit board (not shown), the connected portions 174 are connected and fixed to the circuit board by soldering or the like.

As shown in FIGS. 9 to 13, the plug (mating connector) 300 comprises a plug housing (mating housing) 310 made of an insulator, a plurality of contacts (mating contacts) 330 each made of a metal and two hold downs 380 each made of a metal. The plug 300 is to be mounted on and fixed to an object such as a mating circuit board (not shown). The plug 300 according to the present embodiment is a straight connector whose mating direction (first direction) with the receptacle 100 is a direction (Z-direction) perpendicular to the mating circuit board. Thus, the plug 300 has the mating portion 302 in the Z-direction.

Figure 10:
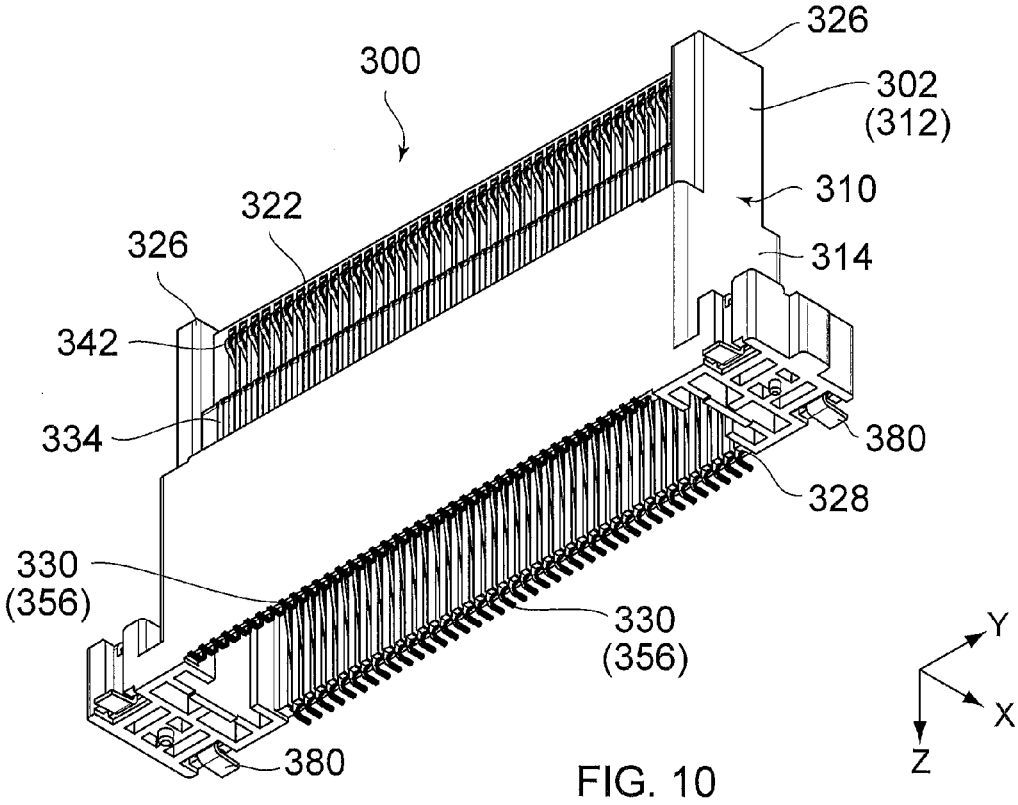
FIG. 10 is a bottom, perspective view showing the plug of FIG. 9.
Figure 11:
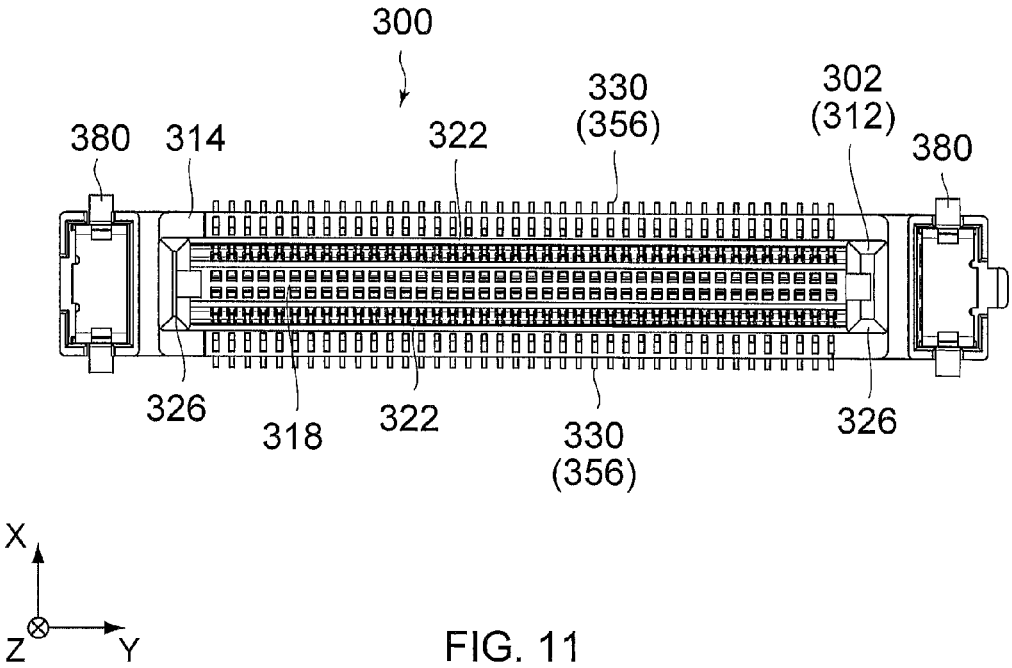
FIG. 11 is a top view showing the plug of FIG. 9.
Figure 12:
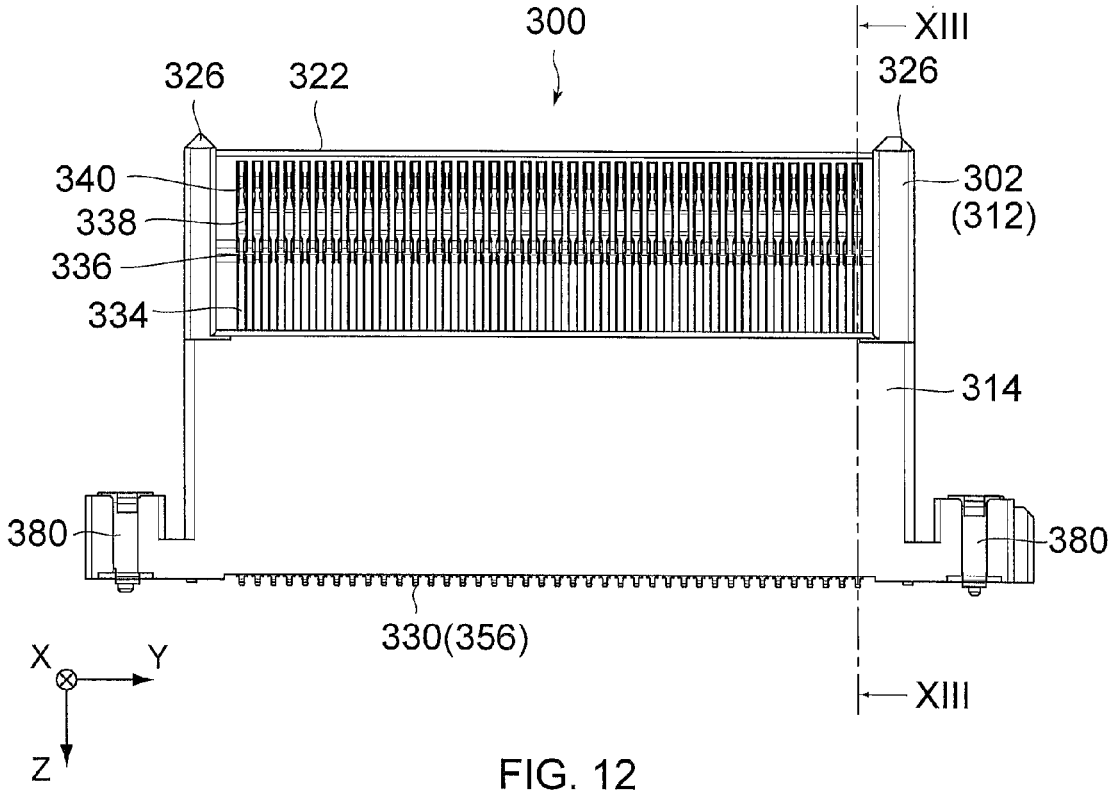
FIG. 12 is a side view showing the plug of FIG. 9.
Figure 13:
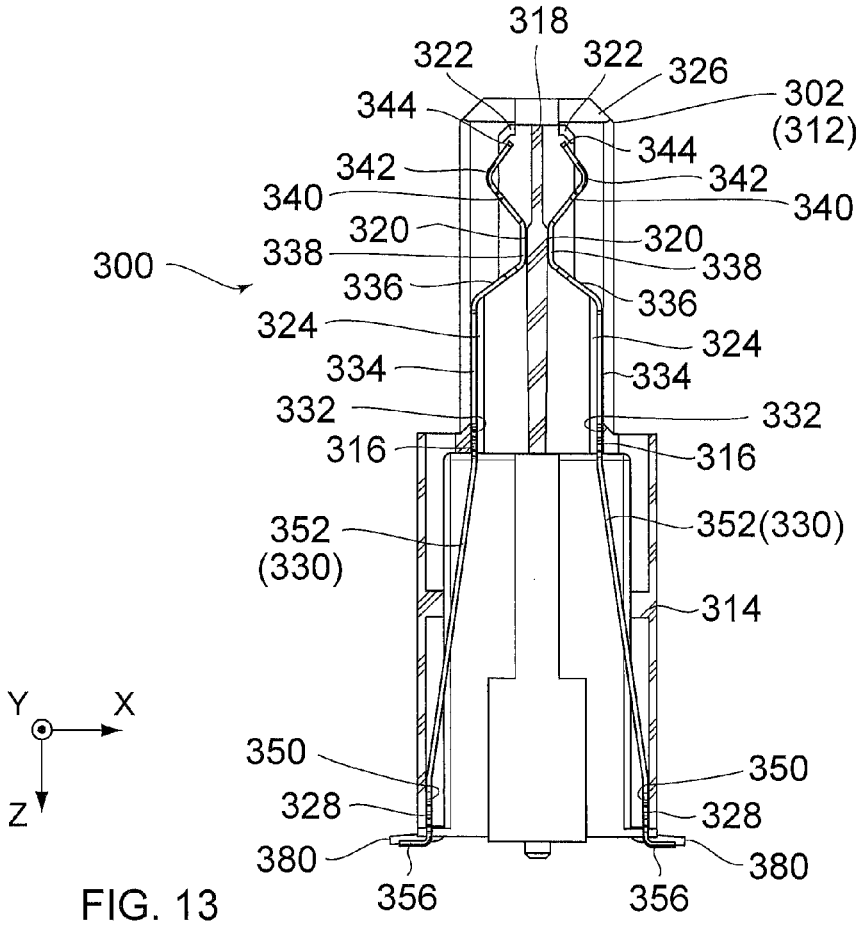
FIG. 13 is a cross-sectional view showing the plug of FIG. 12, taken along line XIII-XIII.

As shown in FIGS. 9, 10 and 13, the plug housing 310 has an insertion end 312 and a base portion 314. The mating portion 302 is mainly formed of the insertion end 312. When the plug 300 is mounted on the mating circuit board (not shown), the base portion 314 is located on the mating circuit board. The base portion 314 is larger than the insertion end 312 in the XY-plane.

As best shown in FIG. 13, the plug housing 310 has a plurality of holding portions 316 which correspond to the contacts 330, respectively. The holding portions 316 are formed in the vicinity of a boundary between the insertion end 312 and the base portion 314. The holding portions 316 are grouped into two groups. The holding portions 316 of each group are arranged in the Y-direction (third direction, or pitch direction). Thus, the holding portions 316 are arranged in two rows. As described later, the holding portion 316 holds a part of the contact 330.

The plug housing 310 has a middle wall 318, a plurality of stop portions 320 which correspond to the contacts 330, respectively, two guard portions 322 and a plurality of second regulation portions 324 which correspond to the contacts 330, respectively. The middle wall 318 is formed within the insertion end 312. The middle wall 318 is located at the middle of the insertion end 312 in the X-direction (second direction) while extending in parallel to the YZ-plane. The stop portions 320 are formed on opposite sides of the middle wall 318 in the X-direction. The guard portions 322 are provided so that the negative Z-side end (upper end) of the middle wall 318 is located therebetween in the X-direction. As described later, the guard portion 322 guards the ends of the contacts 330. The second regulation portions 324 are provided inward of the holding portions 316 in the X-direction, respectively. Thus, the second regulation portion 324 is located between the holding portion 316 and the middle wall 318. As described later, the second regulation portion 324 regulates a movement outward in the X-direction of another part of the contact 330 that is held by the holding portion 316. In the present embodiment, a wall surface located inward of the holding portion 316 in the X-direction is connected to a surface, which faces outward in the X-direction, of the second regulation portion 324.

Referring to FIGS. 9 to 12, the plug 300 has two guided portions 326. The guided portions 326 are provided at opposite ends of the insertion end 312 in the Y-direction, respectively. The guided portions 326 protrude in the negative Z-direction (upward) furthest of all portions of the plug 300. Accordingly, when the mating portion 302 of the plug 300 is received into the receive portion 102 (see FIG. 1) of the receptacle 100, the guided portions 326 are first inserted into the receive portion 102. In detail, the guide ditches 126 of the receptacle 100 are located at opposite ends of the inside of the receive portion 102 in the Y-direction, respectively (see FIGS. 1 and 3). When the mating portion 302 is received into the receive portion 102, the guided portions 326 are guided by the guide ditches 126, respectively.

As shown in FIG. 13, the plug housing 310 has a plurality of board-side holding portions 328 which correspond to the contacts 330, respectively. The board-side holding portions 328 are formed in the vicinity of the positive Z-side end (lower end) of the base portion 314. As described later, the board-side holding portion 328 holds a part of the contact 330. Similar to the holding portions 316, the board-side holding portions 328 are grouped into two groups. The board-side holding portions 328 of each group are formed to be arranged in the Y-direction (FIG. 10).

As shown in FIGS. 9 to 12, the base portion 314 protrudes outward in the Y-direction beyond the insertion end 312 at opposite ends in the Y-direction. The protruding portions of the base portion 314 are attached with the hold downs 380, respectively. When the plug 300 is mounted on and fixed to the mating circuit board (not shown), the hold downs 380 are fixed to the mating circuit board by soldering or the like.

As best shown in FIG. 13, each of the contacts (mating contacts) 330 has a held portion 332, a contact portion (mating contact portion) 334, a support portion 336, a pressed portion 338, a resilient portion 340, a board-side held portion 350, a coupling portion 352 and a connected portion 356. The contact 330 also has a contact end 344. The contact 330 according to the present embodiment is formed by punching out and bending a single metal plate.

Figure 14:
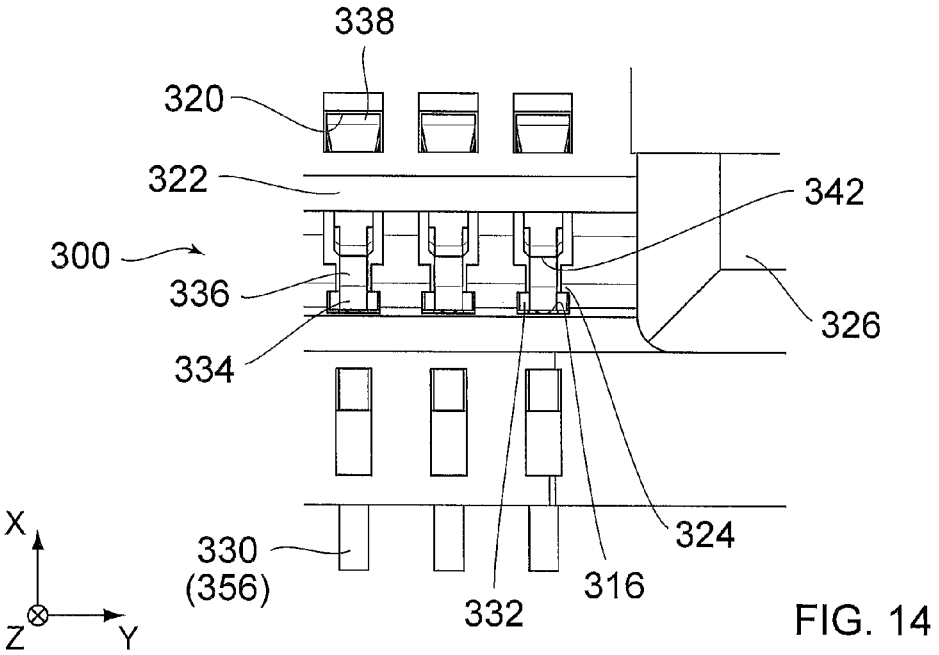
FIG. 14 is an enlarged, top view showing a part of the plug of FIG. 11.
Figure 15:
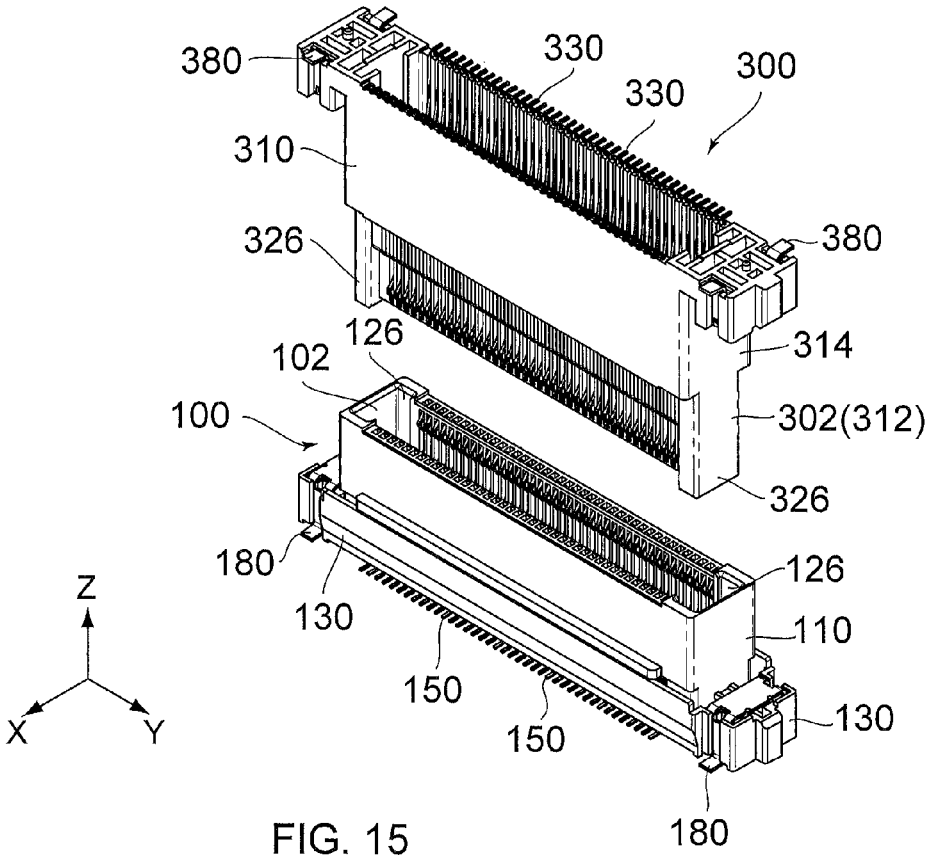
FIG. 15 is a perspective view showing the receptacle of FIG. 1 and the plug of FIG. 9, wherein the receptacle and the plug are in an unmated state.
Figure 16:
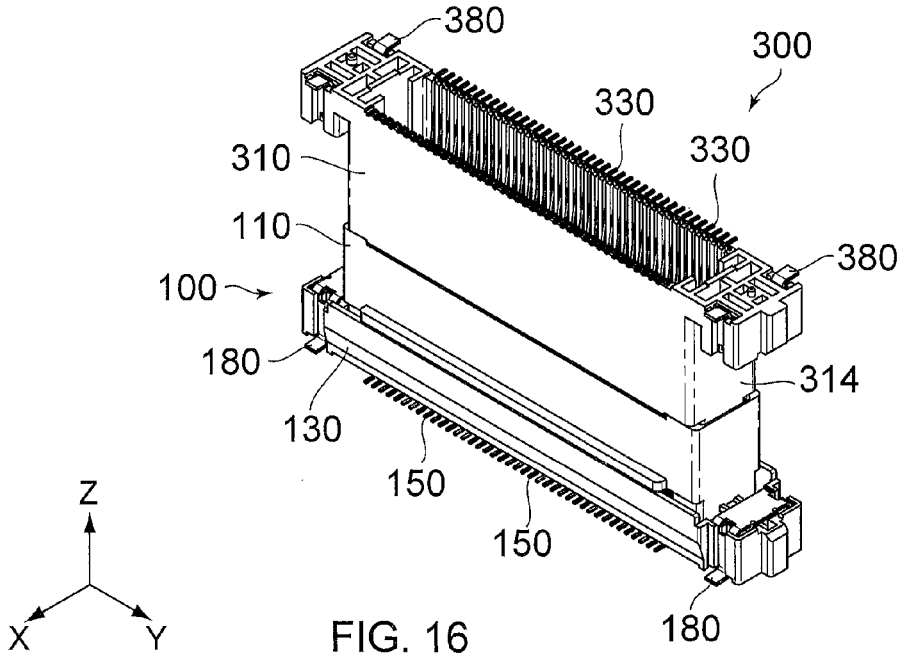
FIG. 16 is another perspective view showing the receptacle of FIG. 1 and the plug of FIG. 9, wherein the receptacle and the plug are in a mated state.
Figure 17:
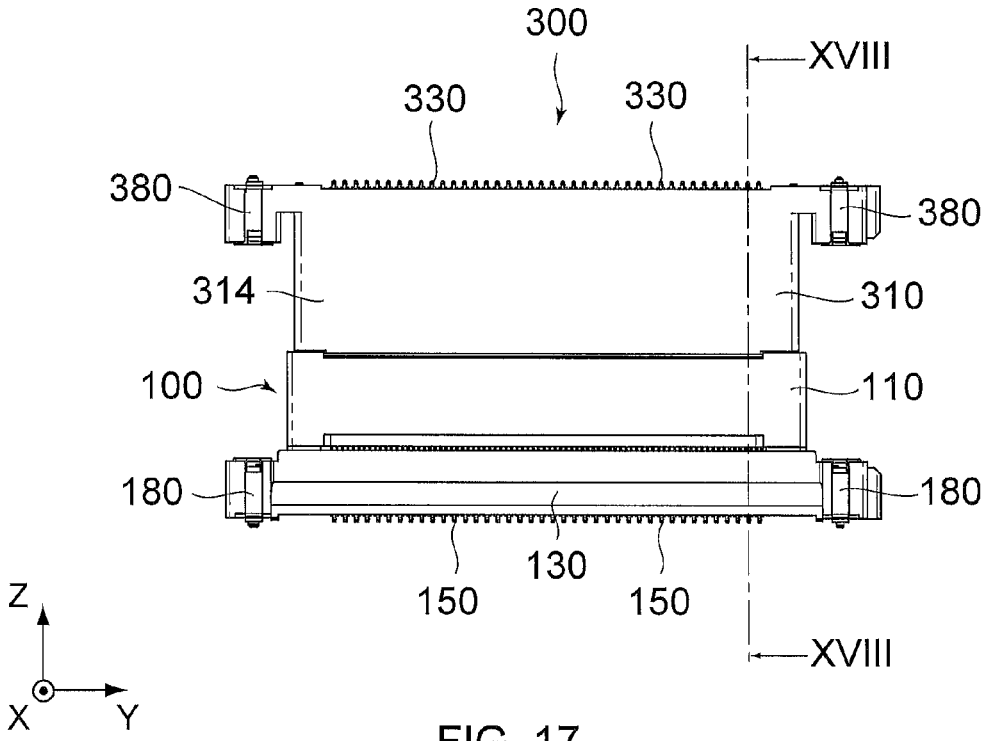
FIG. 17 is a side view showing the receptacle and the plug of FIG. 16.

As shown in FIGS. 13 and 14, the held portions 332 are held by the holding portions 316 of the plug housing 310, respectively. Accordingly, the contacts 330 according to the present embodiment are arranged in two rows. The contact portion 334 extends upward along the negative Z-direction from the held portion 332. The second regulation portion 324 is located inward of the contact portion 334 in the X-direction. Accordingly, the contact portion 334 is not resiliently deformed inward in the X-direction beyond the second regulation portion 324. Thus, a movement of the contact portion 334 in the X-direction is regulated by the second regulation portion 324. The support portion 336 extends in a direction intersecting the Z-direction and the X-direction from an upper end of the contact portion 334. The support portion 336 supports the pressed portion 338.

The pressed portion 338 extends upward along the negative Z-direction from the support portion 336. Thus, the contact portion 334 is provided between the pressed portion 338 and the held portion 332. The pressed portion 338 is located outward of the stop portion 320 of the plug housing 310 in the X-direction. In the present embodiment, the pressed portion 338 is provided so as to be in contact with the stop portion 320 even under the unmated state where the plug 300 is not mated with the receptacle 100. However, the present invention is not limited thereto. For example, the pressed portion 338 may be configured to be brought into contact with and pressed against the stop portion 320 only under the mated state where the plug 300 and the receptacle 100 are mated with each other.

As shown in FIG. 13, the resilient portion 340 extends from the pressed portion 338. The resilient portion 340 has a contact point (mating contact point) 342. The contact point 342 protrudes outward in the X-direction. The resilient portion 340 is resiliently deformable so that the contact point 342 is movable in the X-direction. The pressed portion 338 is provided between the resilient portion 340, which includes the contact point 342, and the held portion 332. The contact end 344 according to the present embodiment is an end of the resilient portion 340. The contact end 344 is located between the contact point 342 and the pressed portion 338 in the X-direction. The guard portion 322 is located over the contact end 344. Thus, in the present embodiment, the contact end 344 is guarded by the guard portion 322. Accordingly, the contact 330 can be prevented from being buckled by a direct abutment of some object with the contact end 344.

As shown in FIG. 13, when an inward force along the X-direction is applied to the contact point 342, the pressed portion 338 also receives an inward force along the X-direction. However, since the pressed portion 338 is pressed against the stop portion 320, a movement of the pressed portion 338 in the X-direction is limited. Accordingly, the inward force along the X-direction mainly deforms the resilient portion 340 resiliently. The thus-configured resilient portion 340 shows sufficient and stable resilient force. Thus, according to the present embodiment, contact reliability of the contact point 342 of the resilient portion 340 can be improved. Especially, in the present embodiment, the pressed portion 338 has a flat shape so that a flat surface of the pressed portion 338 is pressed against the stop portion 320. Accordingly, a starting point of the resilient deformation of the resilient portion 340 is steady.

As shown in FIGS. 13 and 14, the contact point 342 is located between the held portion 332 and the pressed portion 338 in the X-direction. Moreover, the contact point 342 is located between the contact portion 334 and the pressed portion 338 in the X-direction. In detail, the contact point 342 is located outward of the pressed portion 338 in the X-direction. Accordingly, a moving distance of the contact point 342 in the X-direction can be sufficiently enlarged. Moreover, the contact point 342 is located inward of the held portion 332 and the contact portion 334 in the X-direction. Accordingly, the contact point 342 can be prevented from being unnecessarily brought into contact with the receptacle 100 upon the mating of the receptacle 100 with the plug 300.

As shown in FIG. 13, the board-side held portions 350 are held by the board-side holding portions 328 of the plug housing 310, respectively. The coupling portion 352 couples the held portion 332 and the board-side held portion 350 with each other. The connected portion 356 extends opposite to the coupling portion 352 from the board-side held portion 350. When the plug 300 is mounted on and fixed to the mating circuit board (not shown), the connected portion 356 is connected and fixed to the mating circuit board by soldering or the like.

Figure 18:
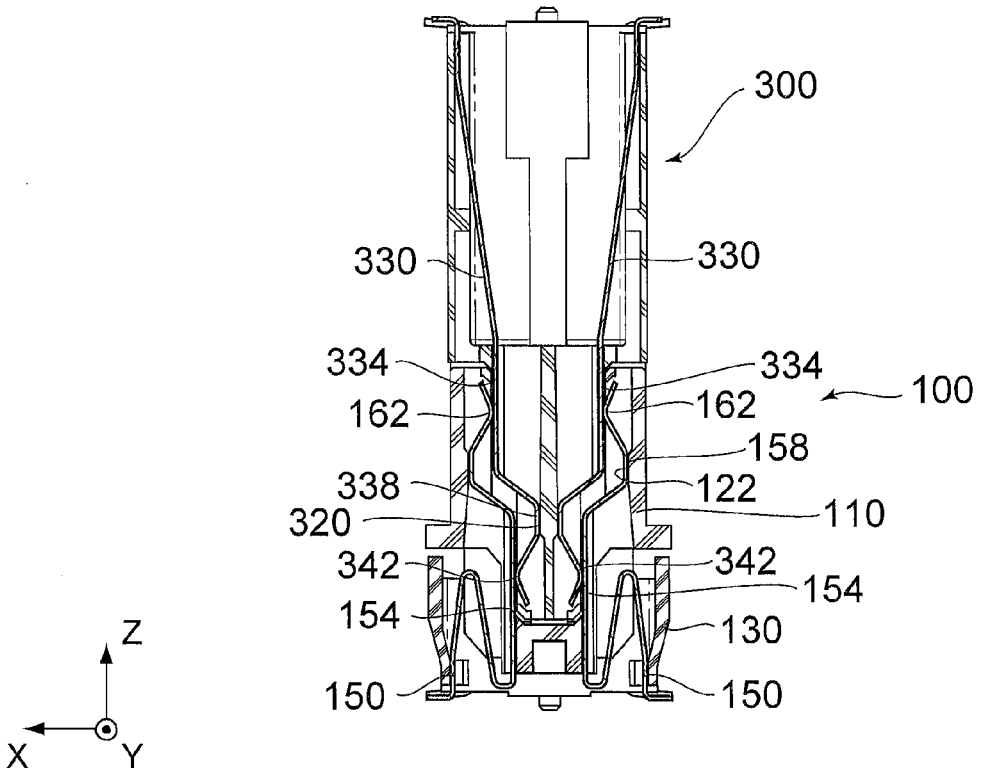
FIG. 18 is a cross-sectional view showing the receptacle and the plug of FIG. 17, taken along line XVIII-XVIII.

As shown in FIGS. 15 to 18, in a mating process of the plug 300 with the receptacle 100, the mating portion 302 and the receive portion 102 are positioned by the guided portions 326 and the guide ditches 126 at first. Meanwhile, the floating housing 110 is movable in the XY-plane since the receptacle 100 has the floating structure. Accordingly, the positioning of the mating portion 302 and the receive portion 102 is relatively easy. Subsequently, when the plug 300 is pushed into the receptacle 100, the mating portion 302 is properly received into the receive portion 102 so that the plug 300 is mated with the receptacle 100. Under the mated state, the contacts (mating contacts) 330 are connected to the contacts 150, respectively. In detail, as shown in FIG. 18, the contact points 162 are brought into contact with the contact portions (mating contact portions) 334, respectively, and moved outward in the X-direction, while the contact points (mating contact points) 342 are brought into contact with the contact portions 154, respectively, and moved inward in the X-direction. Meanwhile, the pressed portions 158 are pressed against the stop portions 122 in the X-direction, respectively, and the pressed portions 338 are pressed against the stop portions 320 in the X-direction, respectively. The contact 150 and the contact (mating contact) 330 are brought into contact with each other at two points under the mated state. Moreover, a distance between these two points in the Z-direction is long. In other words, the mating portion 302 is deeply inserted into the receive portion 102. Generally, a connector having a floating structure might come off a mating connector when the mating connector pivots in the XY-plane. According to the present embodiment, the mating portion 302 is deeply inserted in the receive portion 102, and the contact 150 and the contact (mating contact) 330 are brought into contact with each other at two points. Accordingly, the plug 300 hardly comes off the receptacle 100. When the two contact points structure according to the present embodiment is applied to a floating connector (receptacle 100), a mating connector hardly comes off even if the mating connector pivots in the XY-plane.

In the present embodiment, the contact point 162 is located outward of the held portion 152 and the contact portion 154 in the X-direction. Accordingly, the contact point 162 is not brought into abutment with the contact portion (mating contact portion) 334 upon the connection of the contact 150 to the contact 330 subsequent to the reception of the mating portion 302 into the receive portion 102 (see FIGS. 4 and 18). Similarly, since the contact point (mating contact point) 342 is located inward of the held portion 332 and the contact portion (mating contact portion) 334 in the X-direction, the contact point 342 is not brought into abutment with the contact portion 154 (see FIGS. 13 and 18).

Second Embodiment

Referring to FIGS. 19 to 24, the plug (mating connector) 500 according to a second embodiment of the present invention is to be mounted on and fixed to an object such as a mating circuit board (not shown). As shown in FIGS. 27 to 30, the plug 500 is mateable with the receptacle 100 according to the aforementioned first embodiment. The plug 500 according to the present embodiment is a right angle connector whose mating direction (first direction) with the receptacle 100 is the Z-direction which is in parallel to the mating circuit board. Thus, the plug 500 has a mating portion 502, which is an interface of the plug 500, in the Z-direction. The mating portion 502 has a structure similar to that of the mating portion 302 which is an interface of the plug 300 according to the aforementioned first embodiment. The mating portion 502 is to be received in the receive portion 102 of the receptacle 100. Hereafter, explanation is mainly made about the plug 500. In the following explanation about the plug 500, a side (negative X-side) which is to be mounted on the mating circuit board is referred to as a lower side, while a mating end side (negative Z-side) is referred to as a front side.

Figure 24:
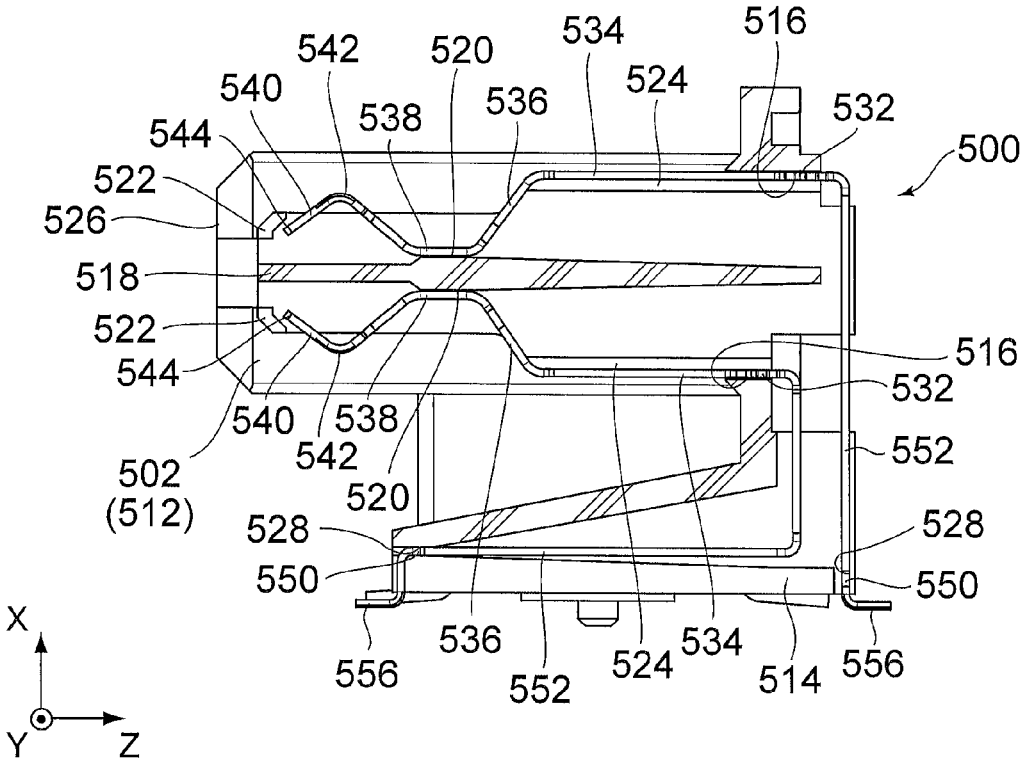
FIG. 24 is a cross-sectional view showing the plug of FIG. 21, taken along line XXIV-XXIV.

As shown in FIGS. 19 to 24, the plug (mating connector) 500 comprises a plug housing (mating housing) 510 made of an insulator, a plurality of contacts (mating contacts) 530 each made of a metal and two hold downs 580 each made of a metal. As shown in FIG. 24, the contacts 530 according to the present embodiment include two types of contacts, namely a first contact and a second contact, which have different shapes from each other. However, the first contact and the second contact are similarly configured. In detail, each of the first contact and the second contact has a main portion arranged in the mating portion 502 and a remaining portion not arranged in the mating portion 502. The main portions of the first contact and the second contact have almost the same shape as each other. Moreover, the remaining portions of the first contact and the second contact have almost the same function as each other. Accordingly, the following explanation is made without distinguishing the first contact and the second contact from each other.

As shown in FIGS. 19 to 23, the plug housing 510 has an insertion end 512 and a base portion 514. The mating portion 502 is mainly formed of the insertion end 512. When the plug 500 is mounted on the mating circuit board (not shown), the base portion 514 is located on the mating circuit board.

As best shown in FIG. 24, the plug housing 510 has a plurality of holding portions 516 which correspond to the contacts 530, respectively. The holding portions 516 are formed at the positive Z-side (rear side) of the insertion end 512. The holding portions 516 are grouped into two groups. The holding portions 516 of each group are arranged in the Y-direction (third direction, or pitch direction). Thus, the holding portions 516 are arranged in two rows. As described later, the holding portion 516 holds a part of the contact 530.

The plug housing 510 has a middle wall 518, a plurality of stop portions 520 which correspond to the contacts 530, respectively, two guard portions 522 and a plurality of second regulation portions 524 which correspond to the contacts 530, respectively. The middle wall 518 is formed within the insertion end 512. The middle wall 518 is located at the middle of the insertion end 512 in the X-direction (second direction) while extending in parallel to the YZ-plane. The stop portions 520 are formed on opposite sides of the middle wall 518 in the X-direction. The guard portions 522 are provided so that the negative Z-side end (front end) of the middle wall 518 is located therebetween in the X-direction. As described later, the guard portion 522 guards the ends of the contacts 530. The second regulation portions 524 are provided inward of the holding portions 516 in the X-direction, respectively. Thus, the second regulation portion 524 is located between the holding portion 516 and the middle wall 518. As described later, the second regulation portion 524 regulates a movement inward in the X-direction of another part of the contact 530 that is held by the holding portion 516. In the present embodiment, a wall surface located inward of the holding portion 516 in the X-direction is connected to a surface, which faces outward in the X-direction, of the second regulation portion 524.

Referring to FIGS. 19 to 23, the plug 500 has two guided portions 526. The guided portions 526 are provided at opposite ends of the insertion end 512 in the Y-direction, respectively. The guided portions 526 protrude in the negative Z-direction (forward) furthest of all portions of the plug 500. Accordingly, when the mating portion 502 of the plug 500 is received into the receive portion 102 (see FIG. 1) of the receptacle 100, the guided portions 526 are first inserted into the receive portion 102. In detail, the guide ditches 126 of the receptacle 100 are located at opposite ends of the inside of the receive portion 102 in the Y-direction, respectively (see FIGS. 1 and 3). When the mating portion 502 is received into the receive portion 102, the guided portions 526 are guided by the guide ditches 126, respectively.

As shown in FIG. 24, the plug housing 510 has a plurality of board-side holding portions 528 which correspond to the contacts 530, respectively. The board-side holding portions 528 are formed in the vicinity of the negative X-side end (lower end) of the base portion 514. As described later, the board-side holding portion 528 holds a part of the contact 530. Similar to the holding portions 516, the board-side holding portions 528 are grouped into two groups. The board-side holding portions 528 of each group are formed to be arranged in the Y-direction.

Figure 19:
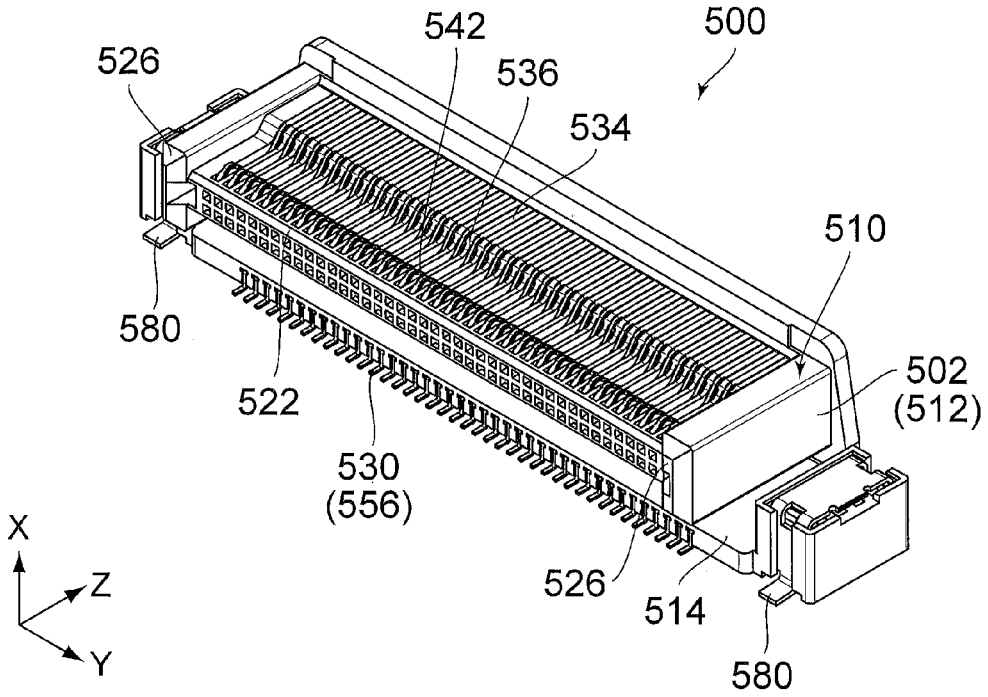
FIG. 19 is a top, perspective view showing a plug according to a second embodiment of the present invention.
Figure 20:
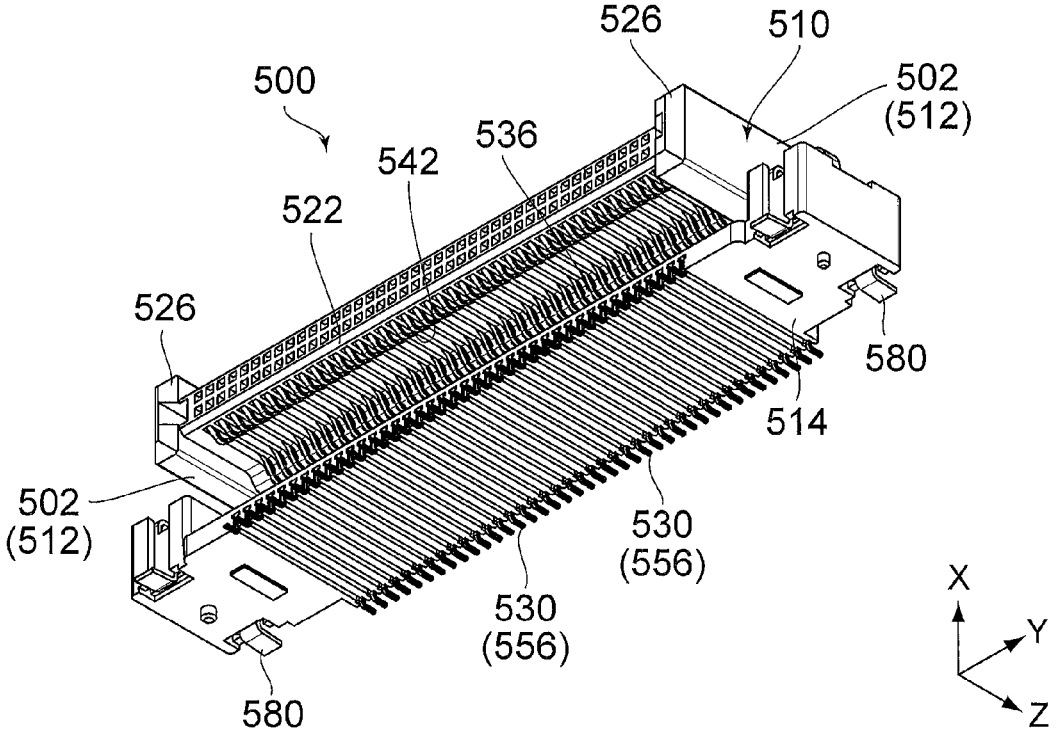
FIG. 20 is a bottom, perspective view showing the plug of FIG. 19.
Figure 21:
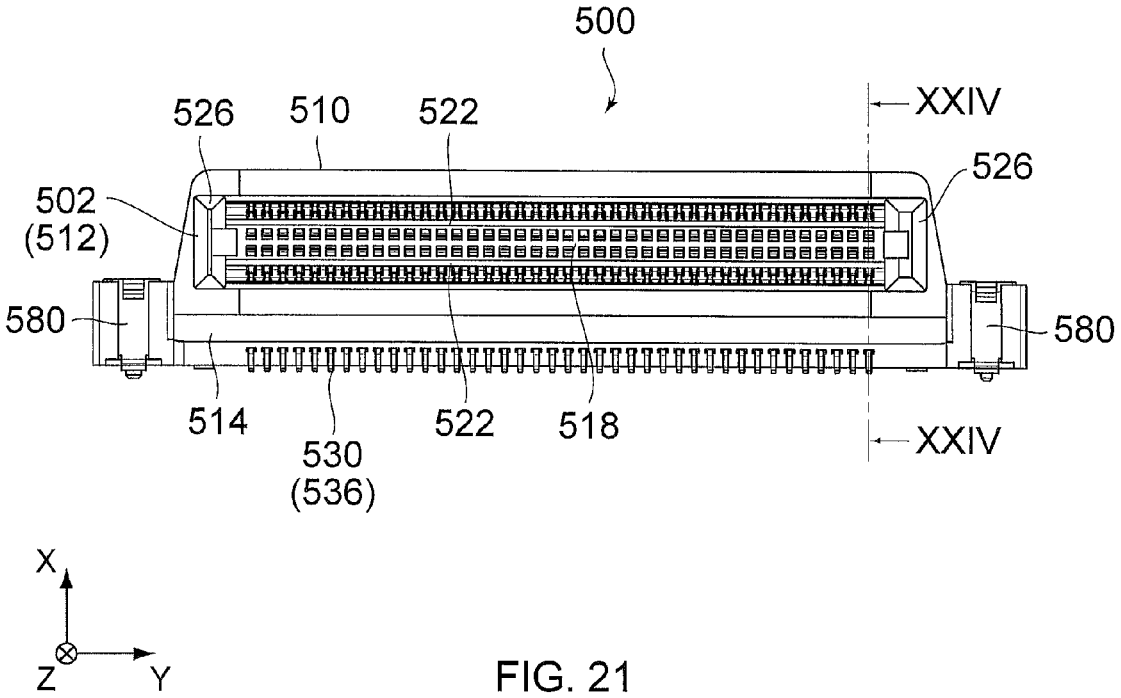
FIG. 21 is a front view showing the plug of FIG. 19.
Figure 22:
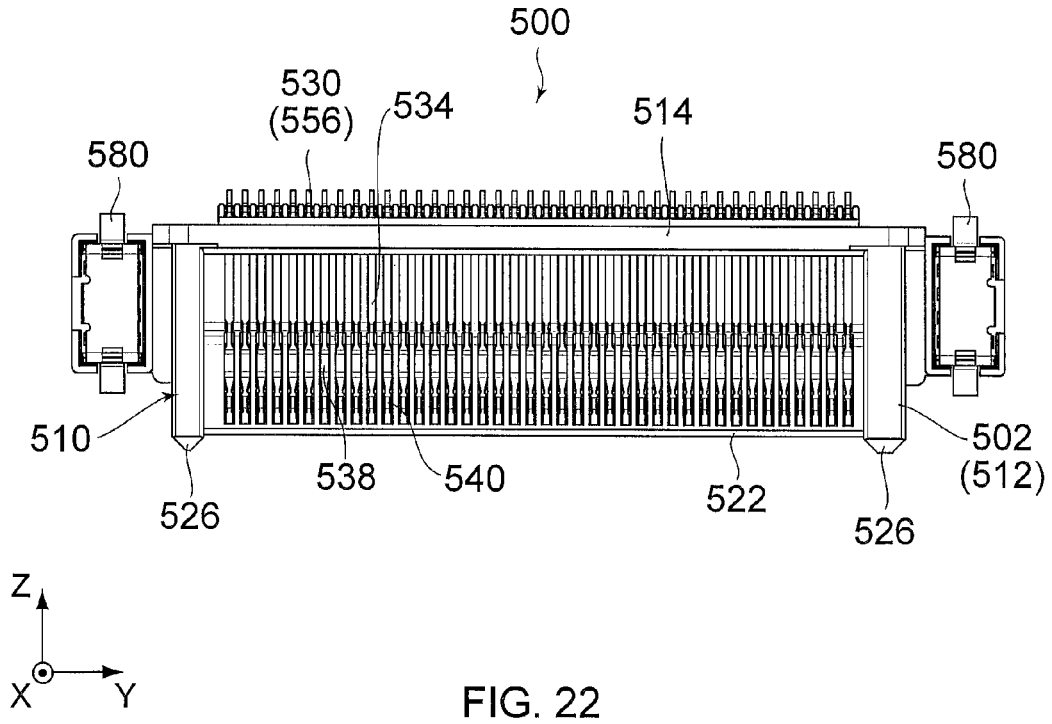
FIG. 22 is a top view showing the plug of FIG. 19.
Figure 23:
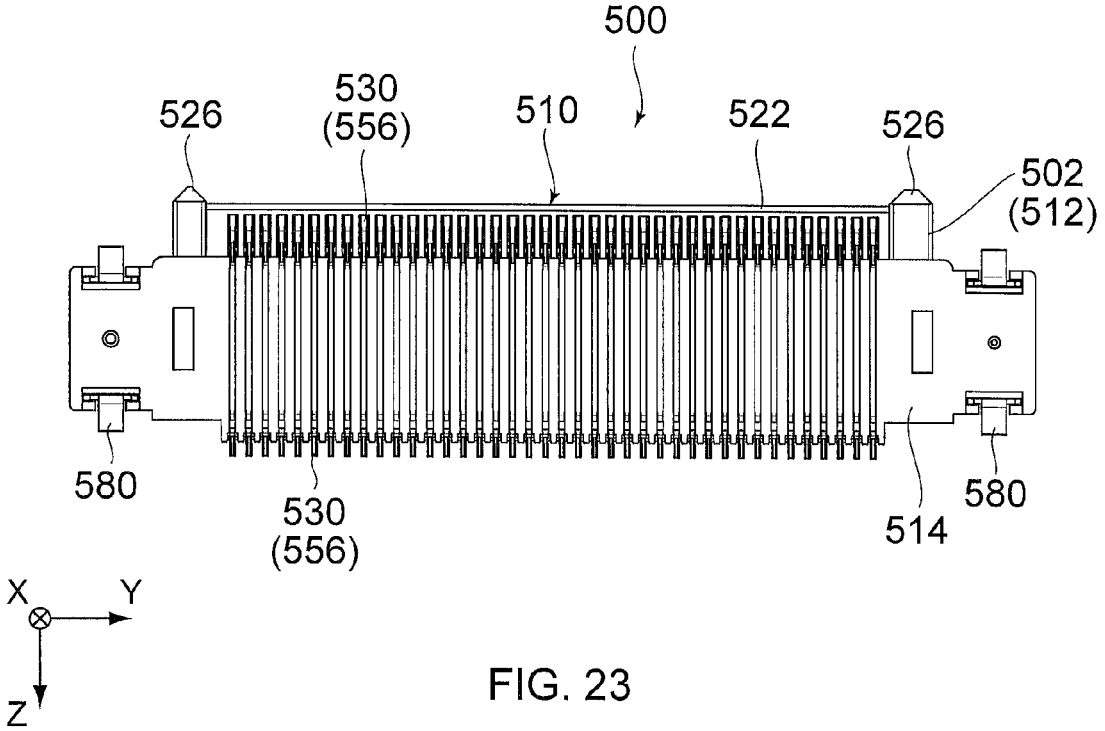
FIG. 23 is a bottom view showing the plug of FIG. 19.
Figure 26:
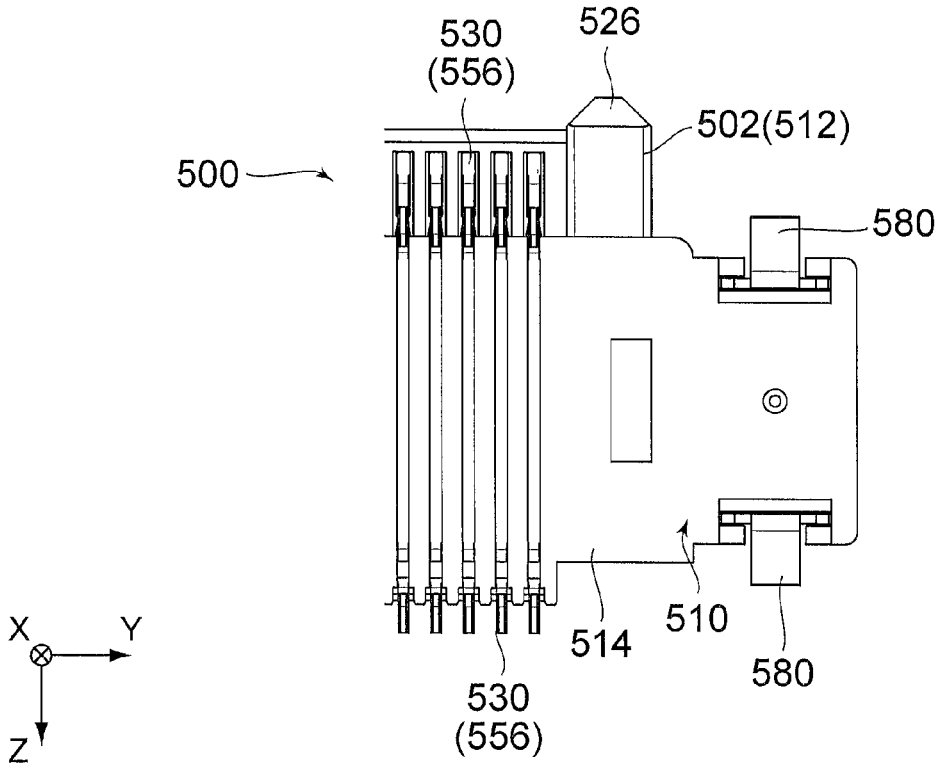
FIG. 26 is an enlarged, bottom view showing a part of the plug of FIG. 23.
Figure 27:
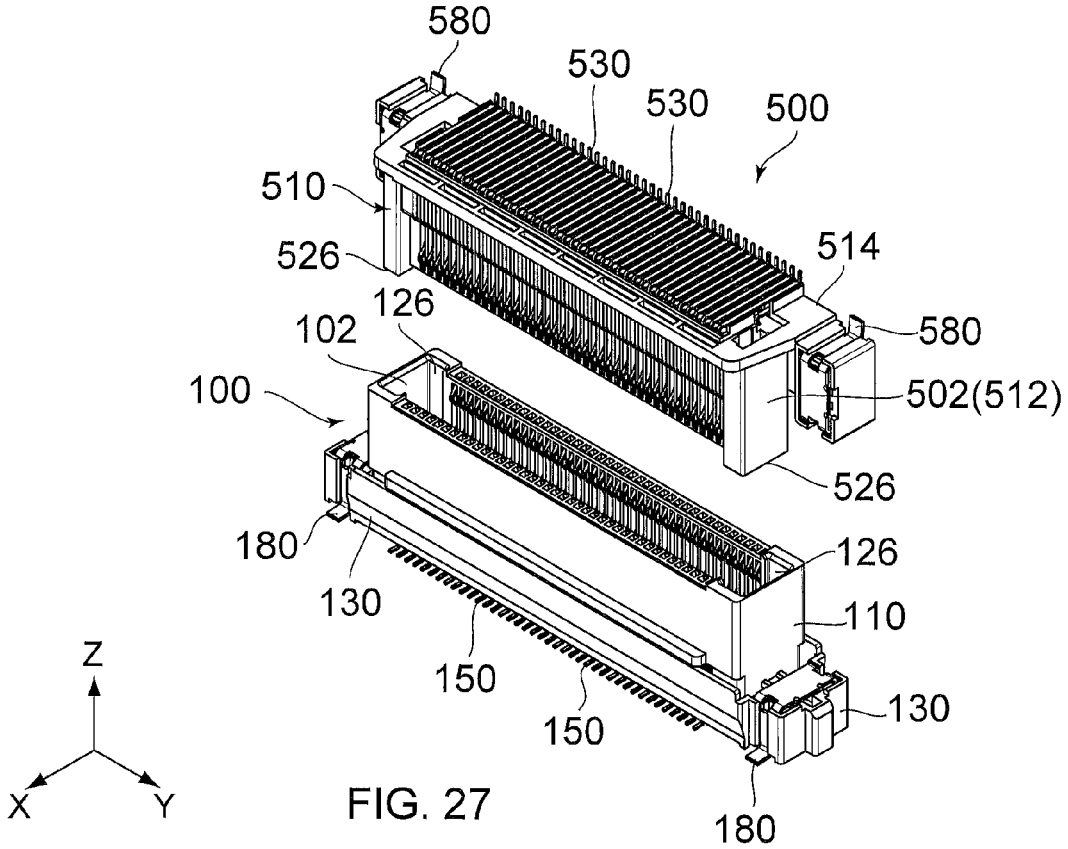
FIG. 27 is a perspective view showing the receptacle of FIG. 1 and the plug of FIG. 19, wherein the receptacle and the plug are in the unmated state.
Figure 28:
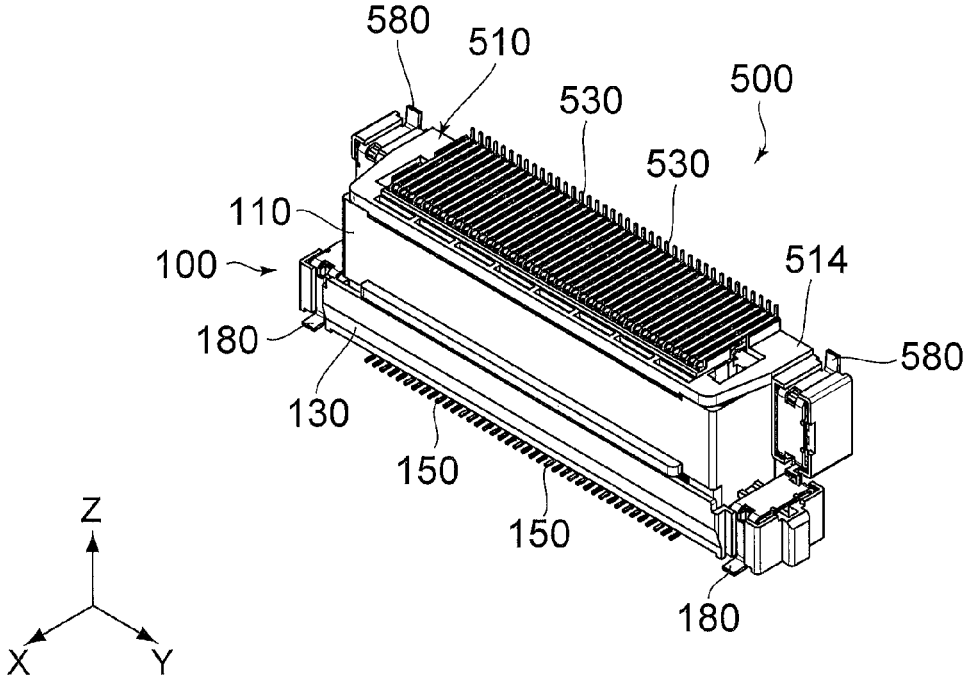
FIG. 28 is another perspective view showing the receptacle of FIG. 1 and the plug of FIG. 19, wherein the receptacle and the plug are in the mated state.
Figure 29:
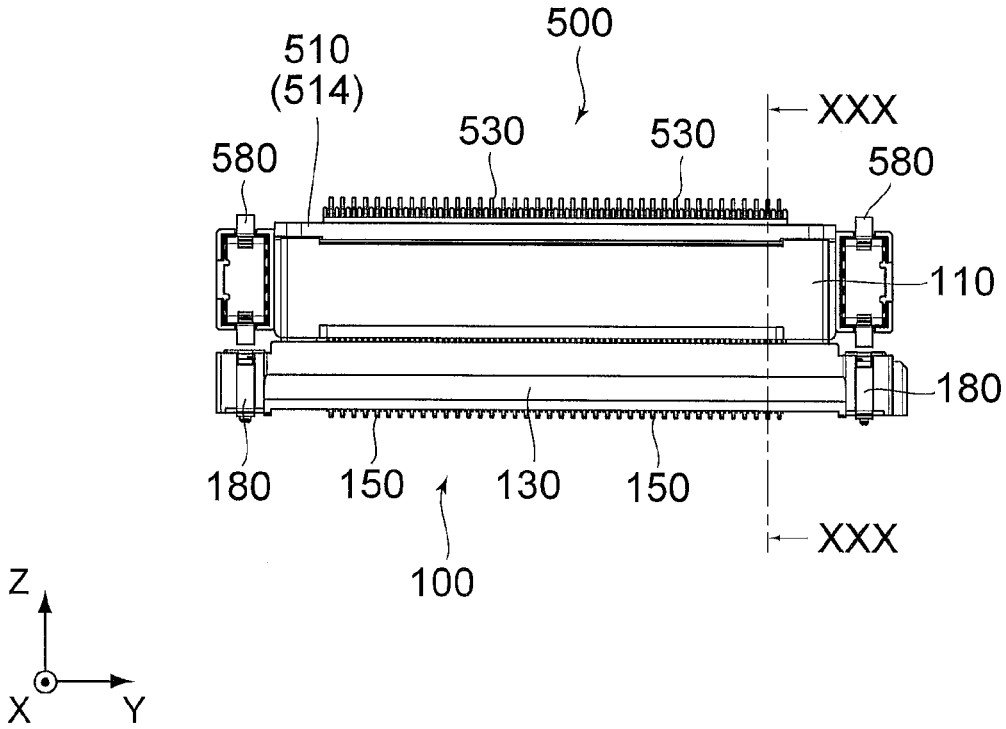
FIG. 29 is a side view showing the receptacle and the plug of FIG. 28.

As shown in FIGS. 19 to 13 and 26, the base portion 514 protrudes outward in the Y-direction beyond the insertion end 512 at opposite ends in the Y-direction. The protruding portions of the base portion 514 are attached with the hold downs 580, respectively. When the plug 500 is mounted on and fixed to the mating circuit board (not shown), the hold downs 580 are fixed to the mating circuit board by soldering or the like.

As best shown in FIG. 24, each of the contacts (mating contacts) 530 has a held portion 532, a contact portion (mating contact portion) 534, a support portion 536, a pressed portion 538, a resilient portion 540, a board-side held portion 550, a coupling portion 552 and a connected portion 556. The contact 530 also has a contact end 544. The contact 530 according to the present embodiment is formed by punching out and bending a single metal plate.

Figure 25:
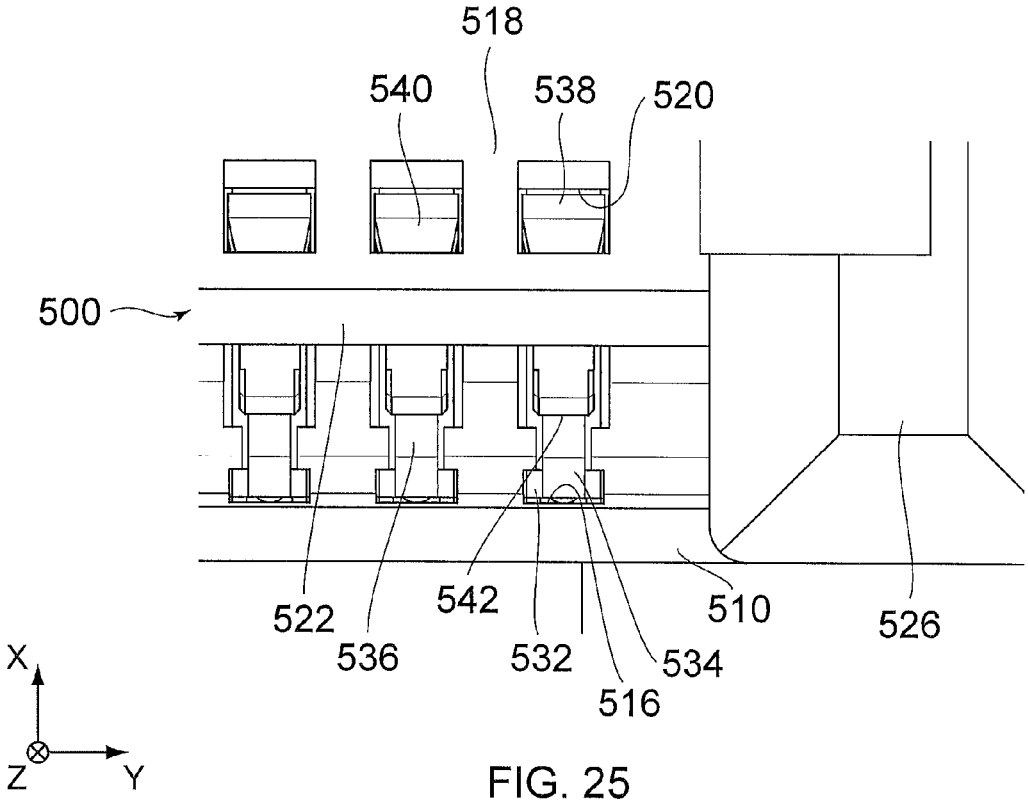
FIG. 25 is an enlarged, front view showing a part of the plug of FIG. 21.

As shown in FIGS. 24 and 25, the held portions 532 are held by the holding portions 516 of the plug housing 510, respectively. Accordingly, the contacts 530 according to the present embodiment are arranged in two rows. The contact portion 534 extends forward along the negative Z-direction from the held portion 532. The second regulation portion 524 is located inward of the contact portion 534 in the X-direction. Accordingly, the contact portion 534 is not resiliently deformed inward in the X-direction beyond the second regulation portion 524. Thus, a movement of the contact portion 534 in the X-direction is regulated by the second regulation portion 524. The support portion 536 extends in a direction intersecting the Z-direction and the X-direction from a front end of the contact portion 534. The support portion 536 supports the pressed portion 538.

The pressed portion 538 extends forward along the negative Z-direction from the support portion 536. Thus, the contact portion 534 is provided between the pressed portion 538 and the held portion 532. The pressed portion 538 is located outward of the stop portion 520 of the plug housing 510 in the X-direction. In the present embodiment, the pressed portion 538 is provided so as to be in contact with the stop portion 520 even under an unmated state where the plug 500 is not mated with the receptacle 100. However, the present invention is not limited thereto. For example, the pressed portion 538 may be configured to be brought into contact with and pressed against the stop portion 520 only under a mated state where the plug 500 and the receptacle 100 are mated with each other.

As shown in FIG. 24, the resilient portion 540 extends from the pressed portion 538. The resilient portion 540 has a contact point (mating contact point) 542. The contact point 542 protrudes outward in the X-direction. The resilient portion 540 is resiliently deformable so that the contact point 542 is movable in the X-direction. The pressed portion 538 is provided between the resilient portion 540, which includes the contact point 542, and the held portion 532. The contact end 544 according to the present embodiment is an end of the resilient portion 540. The contact end 544 is located between the contact point 542 and the pressed portion 538 in the X-direction. The guard portion 522 is located in front of the contact end 544. Thus, in the present embodiment, the contact end 544 is guarded by the guard portion 522. Accordingly, the contact 530 can be prevented from being buckled by a direct abutment of some object with the contact end 544.

As shown in FIG. 24, when an inward force along the X-direction is applied to the contact point 542, the pressed portion 538 also receives an inward force along the X-direction. However, since the pressed portion 538 is pressed against the stop portion 520, a movement of the pressed portion 538 in the X-direction is limited. Accordingly, the inward force along the X-direction mainly deforms the resilient portion 540 resiliently. The thus-configured resilient portion 540 shows sufficient and stable resilient force. Thus, according to the present embodiment, contact reliability of the contact point 542 of the resilient portion 540 can be improved. Especially, in the present embodiment, the pressed portion 538 has a flat shape so that a flat surface of the pressed portion 538 is pressed against the stop portion 520. Accordingly, a starting point of the resilient deformation of the resilient portion 540 is steady.

As shown in FIGS. 24 and 25, the contact point 542 is located between the held portion 532 and the pressed portion 538 in the X-direction. Moreover, the contact point 542 is located between the contact portion 534 and the pressed portion 538 in the X-direction. In detail, the contact point 542 is located outward of the pressed portion 538 in the X-direction. Accordingly, a moving distance of the contact point 542 in the X-direction can be sufficiently enlarged. Moreover, the contact point 542 is located inward of the held portion 532 and the contact portion 534 in the X-direction. Accordingly, the contact point 542 can be prevented from being unnecessarily brought into contact with the receptacle 100 upon the mating of the receptacle 100 with the plug 500.

As shown in FIG. 24, the board-side held portions 550 are held by the board-side holding portions 528 of the plug housing 510, respectively. The coupling portion 552 couples the held portion 532 and the board-side held portion 550 with each other. The connected portion 556 extends from the board-side held portion 550. When the plug 500 is mounted on and fixed to the mating circuit board (not shown), the connected portion 556 is connected and fixed to the mating circuit board by soldering or the like.

Figure 30:
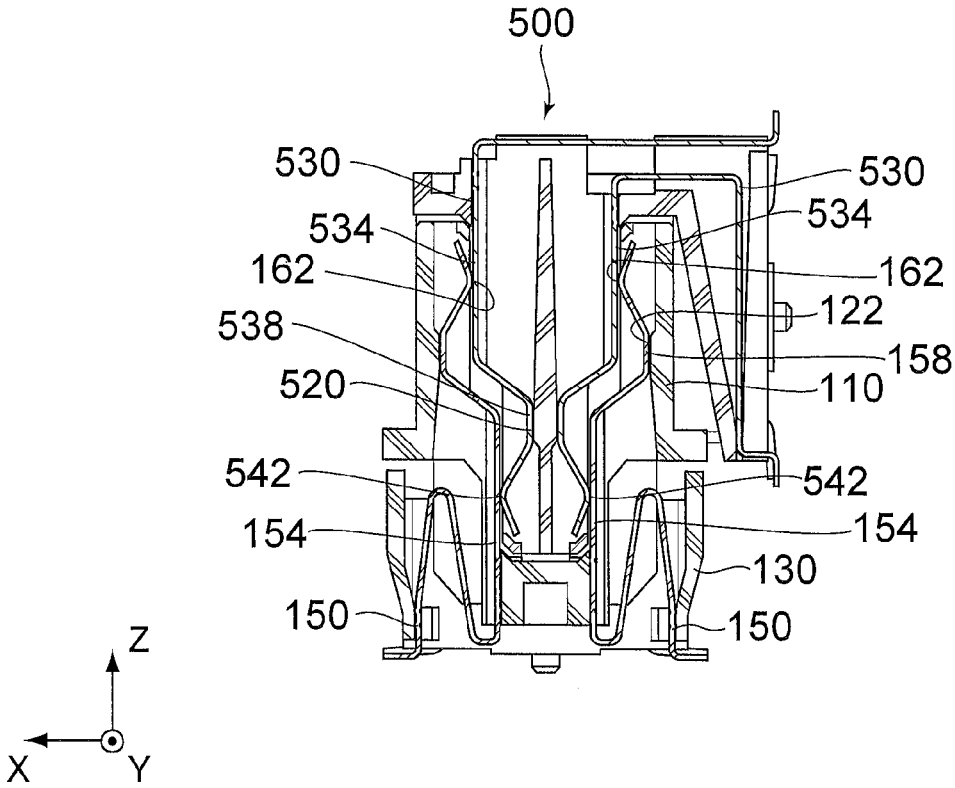
FIG. 30 is a cross-sectional view showing the receptacle and the plug of FIG. 29, taken along line XXX-XXX.
Figure 31:
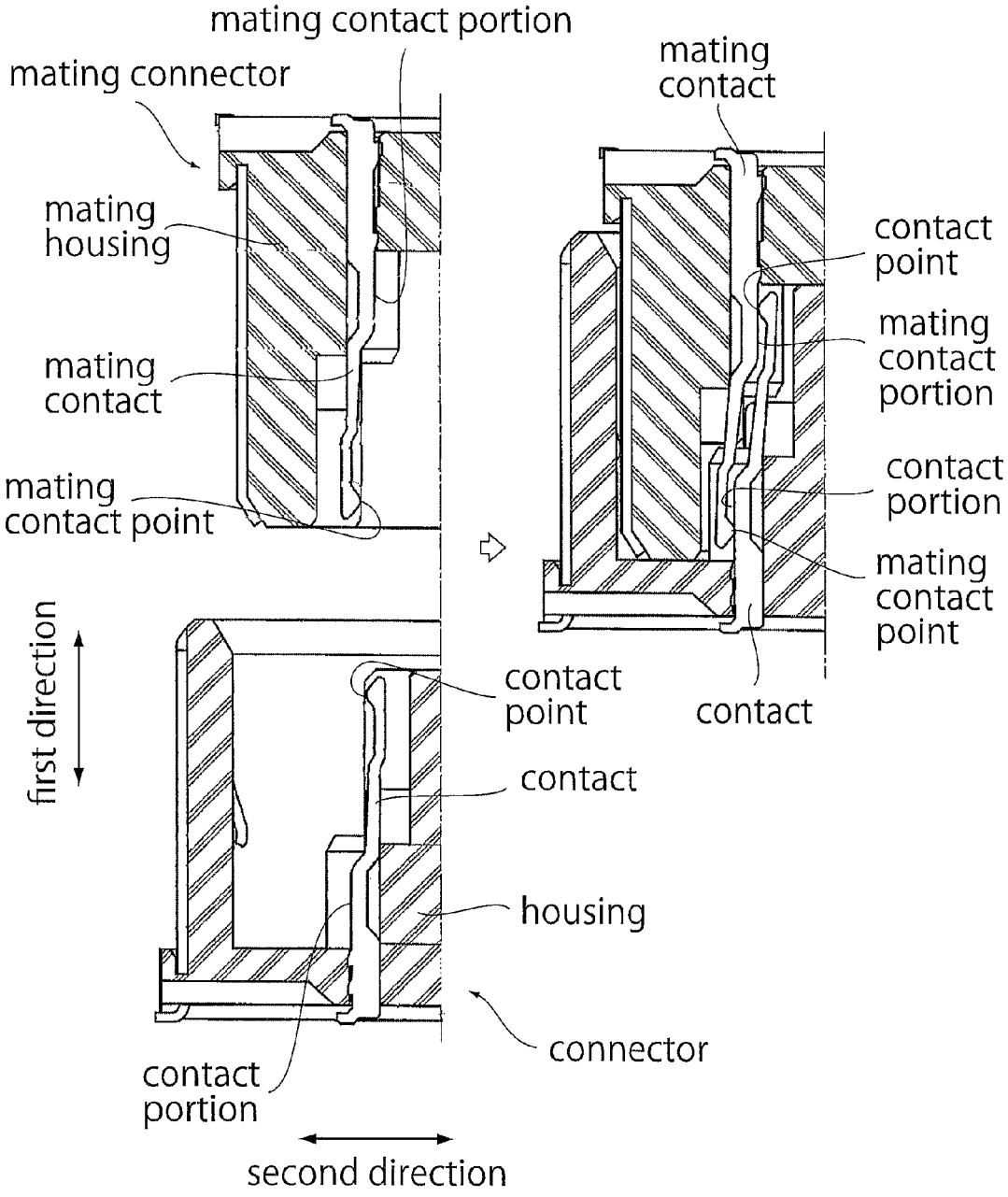
FIG. 31 PRIOR ART
FIG. 31 is a collection of cross-sectional views each showing the connector and/or the mating connector of Patent Document 1.

As shown in FIGS. 27 to 30, in a mating process of the plug 500 with the receptacle 100, the mating portion 502 and the receive portion 102 are positioned by the guided portions 526 and the guide ditches 126 at first. Meanwhile, the floating housing 110 is movable in the XY-plane since the receptacle 100 has the floating structure. Accordingly, the positioning of the mating portion 502 and the receive portion 102 is relatively easy. Subsequently, when the plug 500 is pushed into the receptacle 100, the mating portion 502 is properly received into the receive portion 102 so that the plug 500 is mated with the receptacle 100. Under the mated state, the contacts (mating contacts) 530 are connected to the contacts 150, respectively. In detail, as shown in FIG. 30, the contact points 162 are brought into contact with the contact portions (mating contact portions) 534, respectively, and moved outward in the X-direction, while the contact points (mating contact points) 542 are brought into contact with the contact portions 154, respectively, and moved inward in the X-direction. Meanwhile, the pressed portions 158 are pressed against the stop portions 122 in the X-direction, respectively, and the pressed portions 538 are pressed against the stop portions 520 in the X-direction, respectively. Under the mated state, the contact 150 and the contact (mating contact) 530 are brought into contact with each other at two points which are far apart from each other in the Z-direction. Accordingly, similar to the first embodiment, the plug 500 hardly comes off the receptacle 100 even if the plug 500 pivots in the XY-plane under the mated state of the plug 500 with the receptacle 100.

In the present embodiment, the contact point 162 is located outward of the held portion 152 and the contact portion 154 in the X-direction. Accordingly, the contact point 162 is not brought into abutment with the contact portion (mating contact portion) 534 upon the connection of the contact 150 to the contact 530 subsequent to the reception of the mating portion 502 into the receive portion 102 (see FIGS. 4 and 30). Similarly, since the contact point (mating contact point) 542 is located inward of the held portion 532 and the contact portion (mating contact portion) 534 in the X-direction, the contact point 542 is not brought into abutment with the contact portion 154 (see FIGS. 24 and 30).

The present invention is not limited to the aforementioned embodiments but may be variously modified.

In the aforementioned embodiments, the receptacle 100 is a connector, while each of the plug 300 and the plug 500 is a mating connector. However, each of the contact 330 of the plug 300 and the contact 530 of the plug 500 has portions configured similar to those of the contact 150 of the receptacle 100. In detail, the contact 150 has a main portion formed of portions between the held portion 152 and the contact end 164 (see FIG. 4). Similarly, the contact 330 has a main portion formed of portions between the held portion 332 and the contact end 344 (see FIG. 13), and the contact 530 has a main portion formed of portions between the held portion 532 and the contact end 544 (see FIG. 24). The structural relation between the main portion of the contact 150 and the floating housing 110 can be identified with the structural relation between the main portion of the contact 330 and the plug housing 310. Moreover, the effects due to the structural relations can be identified with each other. Similarly, the structural relation between the main portion of the contact 150 and the floating housing 110 can be identified with the structural relation between the main portion of the contact 530 and the plug housing 510. Moreover, the effects due to the structural relations can be identified with each other. Accordingly, as for these portions, each of the plug 300 and the plug 500 can be considered as a connector, while the receptacle 100 can be considered as a mating connector. In other words, the receptacle 100 may be a mating connector, while each of the plug 300 and the plug 500 may be a connector.

The present application is based on a Japanese patent application of JP2013-013578 filed before the Japan Patent Office on Jan. 28, 2013, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along a first direction, the mating connector comprising a mating contact having a mating contact portion, the connector comprising:

a housing having a holding portion and a stop portion; and a contact having a held portion, a pressed portion and a contact point, the held portion being held by the holding portion, the pressed portion being provided between the contact point and the held portion, the contact point being located between the held portion and the pressed portion in a second direction perpendicular to the first direction, the contact point being brought into contact with the mating contact portion and moved in the second direction under a mated state where the connector and the mating connector are mated with each other, the pressed portion being pressed against the stop portion when the contact point is brought into contact with the mating contact portion;

wherein:

the mating contact has a mating contact point which is movable in the second direction, a movement of the mating contact portion in the second direction is regulated; the contact has a contact portion which is brought into contact with the mating contact point under the mated state;

the contact portion is provided between the pressed portion and the held portion; and the housing has a second regulation portion which regulates a movement of the contact portion in the second direction.

2. The connector as recited in claim 1, wherein the pressed portion is in contact with the stop portion even when the connector is not mated with the mating connector.

3. The connector as recited in claim 1, wherein:

the contact has a resilient portion and a contact end;

the resilient portion extends from the pressed portion and is resiliently deformable;

the contact point is provided at the resilient portion;

the contact end is an end of the resilient portion; and the contact end is located between the contact point and the pressed portion in the second direction.

4. The connector, as recited in claim 1, wherein:

the connector is to be mounted on and fixed to an object;

the connector comprises a base housing other than the housing;

the base housing has an additional holding portion;

the contact has a connected portion, an additional held portion and a flex portion;

the connected portion is to be connected and fixed to the object;

the additional held portion is held by the additional holding portion;

the flex portion couples the held portion and the additional held portion with each other; and the held portion is movable relative to the additional held portion in a plane perpendicular to the first direction.

5. The connector as recited in claim 4, wherein:

the housing is provided with a protrusion;

the protrusion protrudes in a third direction perpendicular to both the first direction and the second direction;

the base housing is provided with a first regulation portion; and when the housing is moved to be apart from the base housing in the first direction, the first regulation portion stops the protrusion and regulates a movement of the housing in the first direction.

6. The connector as recited in claim 5, wherein:

the protrusion has an end in the third direction; and the first regulation portion hides the end of the protrusion when seen along the first direction.

7. The connector as recited in claim 5, wherein the protrusion is formed as a part of the housing.

8. The connector as recited in claim 5, wherein:

the connector comprises a hold down other than the base housing;

the hold down is to fix the base housing to the object;

the hold down is attached to the base housing; and the first regulation portion is a part of the hold down.

9. The connector as recited in claim 8, wherein:

the connector comprises the two hold downs; and each of the hold downs has at least two fixed portions which are to be fixed to the object.

10. The connector as recited in claim 1, wherein the contact is formed by punching out and bending a single metal plate.

* * * * *